US008662635B2

(12) United States Patent
Yuda et al.

(10) Patent No.: US 8,662,635 B2
(45) Date of Patent: Mar. 4, 2014

(54) FLUID EJECTION DEVICE, FLUSHING METHOD, AND FLUSHING PROGRAM

(75) Inventors: Tomohiro Yuda, Minowa-machi (JP); Ryoichi Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/414,100

(22) Filed: Mar. 7, 2012

(65) Prior Publication Data

US 2012/0229565 A1 Sep. 13, 2012

(30) Foreign Application Priority Data

Mar. 7, 2011 (JP) ..... 2011-048707

(51) Int. Cl.
*B41J 2/165* (2006.01)

(52) U.S. Cl.
USPC ..... 347/35

(58) Field of Classification Search
USPC ..... 347/35
See application file for complete search history.

(56) References Cited

U.S. PATENT DOCUMENTS

2002/0024563 A1 * 2/2002 Koitabashi et al. ..... 347/62

FOREIGN PATENT DOCUMENTS

JP 4452432 B2 4/2010
JP 4461811 B2 5/2010

* cited by examiner

*Primary Examiner* — Matthew Luu
*Assistant Examiner* — Alexander D Shenderov
(74) *Attorney, Agent, or Firm* — Global IP Counselors, LLP

(57) ABSTRACT

A fluid ejection device comprising: a first mid-recording flushing unit for ejecting fluid from the plurality of nozzles and carrying out flushing under a first fluid ejection condition during a recording process in accordance with the recording data; and a second mid-recording flushing unit for ejecting the fluid from the nozzles on the head part and carrying out flushing under a second fluid ejection condition in which at least one of the ejection frequency and quantity of the droplets of fluid ejected from the nozzles is greater than with the first fluid ejection condition when the head part is in a recording initiation part of an image that is formed on the recording medium during the recording process.

11 Claims, 16 Drawing Sheets

Fig. 7A

FLUSHING TABLE TA1

| | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | COMPLETION OF EACH PASS | ALL NOZZLES | SH2 SHOT | CD2 |

Fig. 7B

FLUSHING TABLE TA2

| | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM2 SECONDS | ALL NOZZLES | SH2 SHOT | CD2 |

(TM2<TM1)

Fig. 7C

FLUSHING TABLE TA3

| | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM2 SECONDS | ALL NOZZLES | SH3 SHOT | CD2 |

(SH3>SH1)

Fig. 7D

FLUSHING TABLE TA4

| | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | COMPLETION OF EACH PASS | UNUSED NOZZLES | SH2 SHOT | CD2 |

Fig. 7E

FLUSHING TABLE TA5

| | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | COMPLETION OF EACH PASS | NOZZLES TO BE IMMEDIATELY USED | SH2 SHOT | CD2 |

Fig. 8A

FLUSHING TABLE TA6

| TE1°C OR GREATER | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | COMPLETION OF EACH PASS | ALL NOZZLES | SH2 SHOT | CD2 |

| LESS THAN TE1°C | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM1 SECONDS | ALL NOZZLES | SH1 SHOT | |

Fig. 8B

FLUSHING TABLE TA7

| TE1°C OR GREATER | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM2 SECONDS | ALL NOZZLES | SH2 SHOT | CD2 |

| LESS THAN TE1°C | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM3 SECONDS | ALL NOZZLES | SH4 SHOT | CD2 |
| | (TM3>TM2) | | (SH4<SH2) | |

Fig. 8C

FLUSHING TABLE TA8

| INTERLACE | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | COMPLETION OF EACH PASS | ALL NOZZLES | SH2 SHOT | CD2 |

| BAND FEED | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM1 SECONDS | ALL NOZZLES | SH1 SHOT | |

Fig. 8D

FLUSHING TABLE TA9

| INTERLACE | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM2 SECONDS | ALL NOZZLES | SH2 SHOT | CD2 |

| BAND FEED | EJECTION FREQUENCY | RELEVANT NOZZLES | QUANTITY OF DROPLETS EJECTED | |
|---|---|---|---|---|
| RECORDING PRE-INITIATION | ONCE | ALL NOZZLES | SH0 SHOT | |
| MID-RECORDING/ GENERAL PORTIONS | TM1 SECONDS | ALL NOZZLES | SH1 SHOT | CD1 |
| RECORDING-INITIATION PORTION | TM3 SECONDS | ALL NOZZLES | SH4 SHOT | CD2 |
| | (TM3>TM2) | | (SH4<SH2) | |

COMPARATIVE EXAMPLE

| PASS NUMBER | 0 | 1 | 2 | 3 | 4 | 5 | 6 | 7 | ··· |
|---|---|---|---|---|---|---|---|---|---|
| CUMULATIVE TIME | | 0 | t | 2t | 3t | 4t | 5t | 6t | ··· |
| FLUSHING | ○ | × | × | × | × | × | × | ○ | ··· |

FLUID EJECTION DEVICE, FLUSHING METHOD, AND FLUSHING PROGRAM

CROSS-REFERENCE TO RELATED APPLICATIONS

This application claims priority to Japanese Patent Application No. 2011-048707 filed on Mar. 7, 2011. The entire disclosures of Japanese Patent Application No. 2011-048707 is hereby incorporated herein by reference.

BACKGROUND

1. Technical Field

The present invention relates to a technology for devices that feed a recording medium relative to a head part on which a plurality of nozzles are aligned in the feed direction of the recording medium, and eject a fluid from nozzles while the medium is fed.

2. Background Technology

For example, ink-jet recording devices are known fluid ejection devices in which ink droplets (fluid) are ejected from an ink jet recording head in accordance with recording data as the recording medium travels in the feed direction. With ink jet recording heads, however, because of the relationship whereby the ink is ejected from the nozzle openings as a result of being pressurized in a pressure generation chamber, there is the potential for increase in ink viscosity or solidification of the ink due to evaporation of solvent from the nozzle opening, as well as attachment of dirt to the nozzles, or ingress of air bubbles, leading to nozzle clogging. For this reason, with ink jet recording devices, the surface formed by the nozzles on the ink jet recording head is sealed by capping unit in non-printing regions, ink is suctioned and ejected by a suction pump in this capping unit, and the surface of the recording head formed by the nozzle is wiped by wiping unit, thereby being cleaned. In addition, with ink jet recording devices, flushing (air ejection operation) is carried out whereby ink is ejected from the nozzle openings in a non-printing region (flushing region).

For example, with the flushing device described in patent document 1, the sprayed fluid constituent components pass through an opening part of the main unit and temporarily accumulate in an accumulation part. The accumulated fluid constituent components are eliminated from the accumulation part with a removal part for moving the accumulation part with respect to the main unit, and the accumulated material falls down and is retained in a retaining part. In addition, with the fluid ejected device of patent document 2, a pressure generation element operates when it is determined that a nonuniform increase in viscosity has occurred in the fluid in the vicinity of the meniscus of the nozzle opening. Tiny changes in pressure are thus made to occur in the fluid inside the pressure generation chamber, causing tiny oscillations in the fluid in the vicinity of the meniscus. After causing these tiny oscillations, the pressure generation element is made to operate, thereby performing flushing.

Japanese Patent Registration Nos. 4461811 (Patent Citation 1) and 4452432 are examples of the related art.

SUMMARY

Problems to be Solved by the Invention

When a plurality of nozzles are aligned on the recording head in the paper feed direction, if the recording head is in a recording-initiation portion of the image that is to be formed on the recording medium, then nozzles that are in a portion of the formed image will be used in ink ejection. On the other hand, nozzles that are not in a portion of the formed image will not be used in ink ejection. It can thus be conjectured that the ink viscosity in the nozzles that are not used for ink ejection will increase relative to the nozzles that are used for ink ejection. Consequently, when a nozzle that is not being used in ink ejection comes to a portion of the formed image as a result of paper feeding, the thick ink with increased viscosity will be ejected onto the recording-initiation portion of the formed image. Density irregularity occurs, where the ink becomes thicker in the recording-initiation portions of images that are formed on recording media.

In light of the above, an advantage of the invention is to reduce density irregularity in fluids in recording-initiation portions of images that are formed on recording media.

Means Used to Solve the Above-Mentioned Problems

In order to attain this objective, a fluid ejection device is provided wherein a fluid is ejected towards a recording medium from a plurality of nozzles in accordance with recording data while the recording medium is fed in a feed direction with respect to a head part on which the nozzles are aligned in the feed direction of the recording medium. The fluid ejection device includes:

first mid-recording flushing unit for ejecting fluid from the plurality of nozzles and carrying out flushing under first fluid ejection conditions during a recording process in accordance with the recording data; and second mid-recording flushing unit for ejecting fluid from nozzles on the head part and carrying out flushing under second fluid ejection conditions in which at least one of the ejection frequency and quantity of droplets of fluid ejected from the nozzles is greater than with the first fluid ejection conditions when the head part is in a recording initiation part of the image that is formed on the recording medium during the recording process.

Specifically, when the head part is in a recording-initiation portion of the formed image, a second mid-recording flushing is carried out in which at least one of the ejection frequency of fluid from the nozzle or the quantity of droplets ejected is increased. Consequently, in this aspect, density irregularity in the recording-initiation portions of an image that is formed on a recording medium can be reduced.

Travel of the recording medium with respect to the head part in the direction of a travel unit that at least one of the head part and the recording medium is made to move and includes movement of the recording medium with respect to a non-moving head part, movement of the head part with respect to a non-moving recording medium, or movement of both the head part and the recording medium. The fluid referred to above can be the material that forms the image on the recording medium, but materials can include fluids and powders, more specifically, inks, toners, and the like. The image that is formed on the recording medium can be formed on the recording medium by ejection of fluid, but formation also includes affixing of fluid to the recording medium and formation of nonuniformities on the recording medium. In addition, the image that is formed on the recording medium can be formed as multiple images or as a single image in accordance with a single set of recording data. When blank portions are present in the feed direction between images on the recording medium, the second mid-recording flushing can be carried out when the head part is at the recording initiation part of the images on either side of a blank portion.

The flushing that is carried out though ejection of fluid from the nozzle includes movement of the head part to a flushing position and ejection of fluid towards a non-recording position, movement of an ejected fluid receiving unit to a position opposite the nozzle and ejection of fluid towards the receiving unit, withdrawing of the recording medium and ejection of fluid towards a non-recording position, and combinations thereof. The ejection frequency of fluid from the nozzle includes frequency based on the number of passes indicating the interval in passes at which flushing is carried out, and frequency based on time indicating the interval in seconds at which flushing is carried out. The first mid-recording flushing and the second mid-recording flushing can refer to flushing in which all of the nozzles are switched simultaneously, or flushing in which the first mid-recording flushing is carried out with some of the plurality of nozzles, whereupon the second mid-recording flushing is carried out with the remaining nozzles. The recording initiation part of the image includes a first recording initiation part of a first image that is formed on the recording medium during the recording process and a second recording initiation part of the second image that comes after a blank portion in the feed direction as generated between the first image and the second image on the recording medium. Specifically, fluid density irregularity is also decreased in the image initiation portions of the image subsequent to blank portions in the feed direction.

In this connection, with the second mid-recording flushing means, those nozzles of the plurality of nozzles which have not been used in the formation of the aforementioned image can be placed under the second fluid ejection conditions. When this is done, the consumed amount of fluid in the second mid-recording flushing can be reduced.

The second mid-recording flushing unit can carry out flushing only for those nozzles, among the plurality of nozzles, that have moved from a position that is in front of the recording initiation part to a position that is on the formed image in the feed direction during feeding of the recording medium. The nozzles that are still in front of the recording initiation part during recording medium feeding are thus not used for fluid ejection. Consequently, the consumed amount of fluid in the second mid-recording flushing can be reduced.

Temperature detection unit for detecting the temperature of the fluid ejection device can be provided. The fluid ejection device can select whether or not flushing is to be carried out by the second mid-recording flushing unit in accordance with the temperature that is detected by the temperature detection unit. When this is done, flushing can be carried out in accordance with the temperature of the fluid ejection device.

The fluid ejection device can form an image on the recording medium in a plurality of image formation modes that are related to image formation. The fluid ejection device can decide whether or not flushing is to be carried out by the second mid-recording flushing unit in accordance with the image formation mode. When this is done, flushing can be carried out in accordance with the image formation mode.

In addition, when the image formation mode is set so that the recording medium is fed in the feed direction by an amount smaller than an entire length of the head part including the plurality of nozzles that are aligned in the feed direction, the fluid ejection device need not carry out flushing using the second mid-recording flushing unit. With this type of image formation mode, the head part can be disposed so that the nozzles are not in front of the recording initiation part, even if the head part is in the recording initiation part of the formed image. Therefore, the consumed amount of fluid in the mid-recording flushing can be reduced. On the other hand, when the image recording mode is set so that the recording medium is fed in the feed direction in units that are smaller than units of the plurality of nozzles that are aligned in the feed direction, the fluid ejection device can carry out flushing with the second mid-recording flushing unit. In this image formation mode, when the head is in the recording initiation part of the formed image, the nozzles can be disposed in front of the recording initiation part in some cases. For this reason, density irregularity of the fluid in the recording-initiation portion of the formed image is reduced by the second mid-recording flushing.

In addition, the second fluid ejection conditions of the second mid-recording flushing unit can be fluid ejection conditions according to the image formation mode described above. When this is done, flushing can be carried out according to the image formation mode.

The configurations described above can be utilized with fluid ejection control devices, printing control devices, printing devices, flushing methods including steps such as a recording pre-initiation flushing step, a first mid-recording flushing step, and a second mid-recording flushing step, recording methods having steps such as a recording step, printing control methods, printing methods, flushing programs in which, for example, a recording pre-initiation flushing function, a first mid-recording flushing function, and a second mid-recording flushing function are realized in a computer, recording programs in which a function such as a recording function is realized in a computer, printing control programs, printing programs, and media that can be read by a computer on which these programs have been recorded.

BRIEF DESCRIPTION OF THE DRAWINGS

Referring now to the attached drawings which form a part of this original disclosure:

FIG. 7 shows schematic diagrams (A to E) of the structure of a flushing table;

FIG. 8 shows schematic diagrams (A to D) of the structure of a flushing table;

DETAILED DESCRIPTION OF EXEMPLARY EMBODIMENTS

(1) Summary of the Flushing Method

Figure 1:
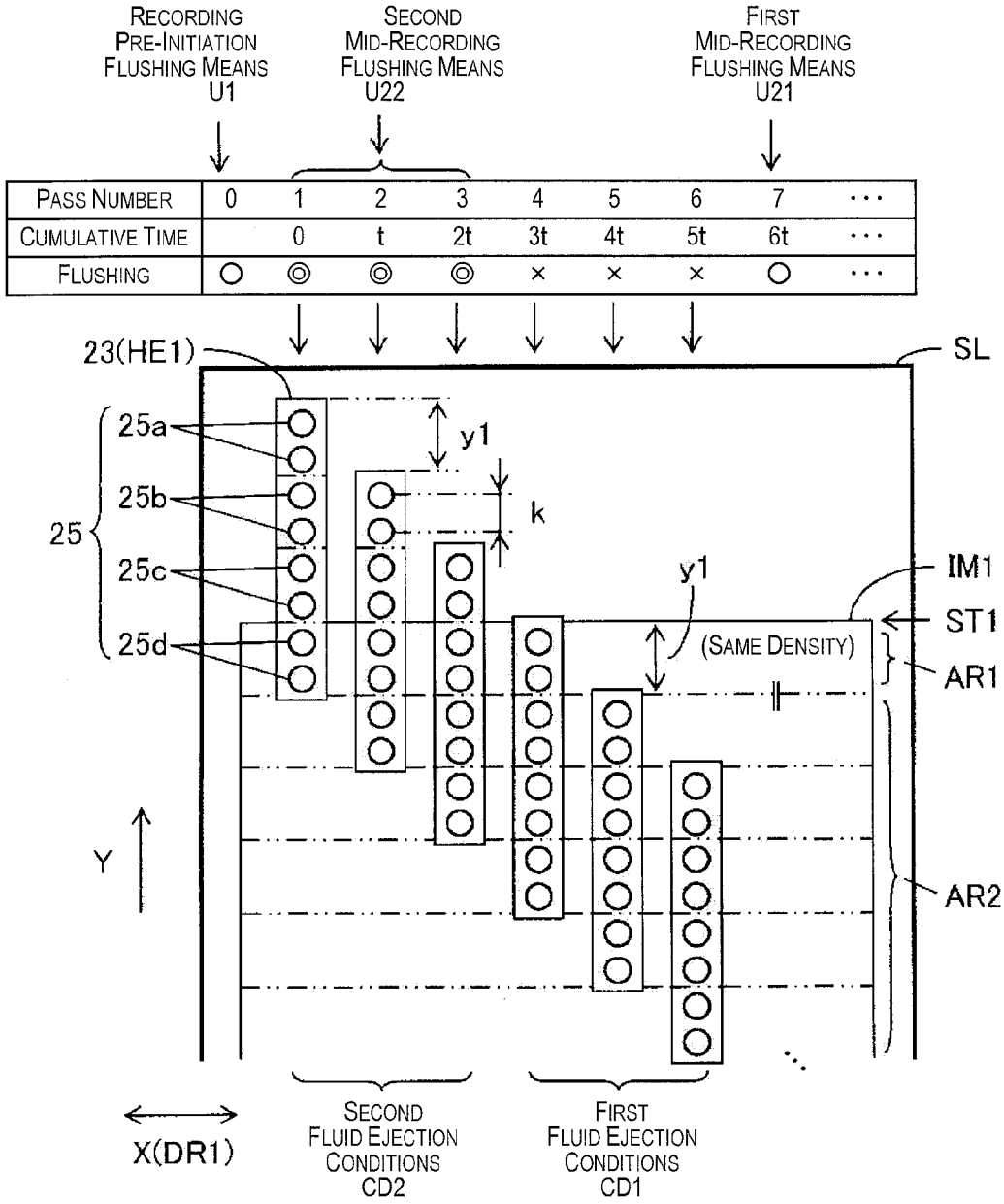
FIG. 1 is a schematic diagram summarizing the flushing method.

First, a summary of the flushing method pertaining to an aspect of the invention will be described with reference to FIGS. 1, 2, and 15. The fluid ejection device exemplified by an ink jet printer 11 ejects fluid FL1 towards a recording medium SL from nozzles 25 in accordance with recording data DA1 as a recording medium SL is fed in a feed direction Y with respect to a head part HE1. A plurality of nozzles 25 are aligned in the feed direction Y of the recording medium SL on the head part HE1.

The fluid ejection device has first mid-recording flushing means (unit) U21 and second mid-recording flushing means (unit) U22. As necessary, the fluid ejection device also has recording pre-initiation flushing means (unit) U1. In this case, the recording pre-initiation flushing means U1 corresponds to the recording pre-initiation flushing step and the recording pre-initiation flushing function, the first mid-recording flushing means U21 corresponds to the first mid-recording flushing step and the first mid-recording flushing function, and the second mid-recording flushing means U22 corresponds to the second mid-recording flushing step and the second mid-recording flushing function. These means U1, U21, and U22 are not means signifying that nozzles dedicated for each means are provided, but rather signify that flushing carried out with shared nozzles changes in accordance with the time of execution. These means U1, U21, and U22 can be constituted by specific means whereby software and hardware work in conjunction, or by specific means whereby software is loaded into a computer, or by basic hardware resources such as integrated circuits referred to as application-specific ICs (ASICs). The recording pre-initiation flushing means U1 refers to recording pre-initiation flushing whereby fluid FL1 is ejected from a plurality of nozzles 25 prior to initiation of the recording process in accordance with the recording data DA1.

The first mid-recording flushing means U21 carries out a first mid-recording flushing by ejecting fluid FL1 from a plurality of nozzles 25 under the first fluid ejection conditions CD1 during recording processing in accordance with the recording data DA1. The fluid ejection conditions include at least one of the quantity of droplets of ejected and the ejection frequency of fluid FL1 from the nozzles 25. The fluid ejection frequency refers to the number of flushing repetitions per unit time, and an increase in ejection frequency indicates an increase in the number of flushing repetitions per unit of time. The quantity of ejected fluid droplets refers to the quantity of drops of fluid ejected during a single flushing, and an increase in quantity of droplets ejected indicates an increase in the quantity of droplets ejected during a single flushing. The first mid-recording flushing in the printing device is the flushing that is carried out during the printing process and when carried out periodically, is referred to as "periodic flushing" or the like. This periodic flushing normally is set at an interval that is longer than a single pass of the recording head (one primary scan).

Figure 15:
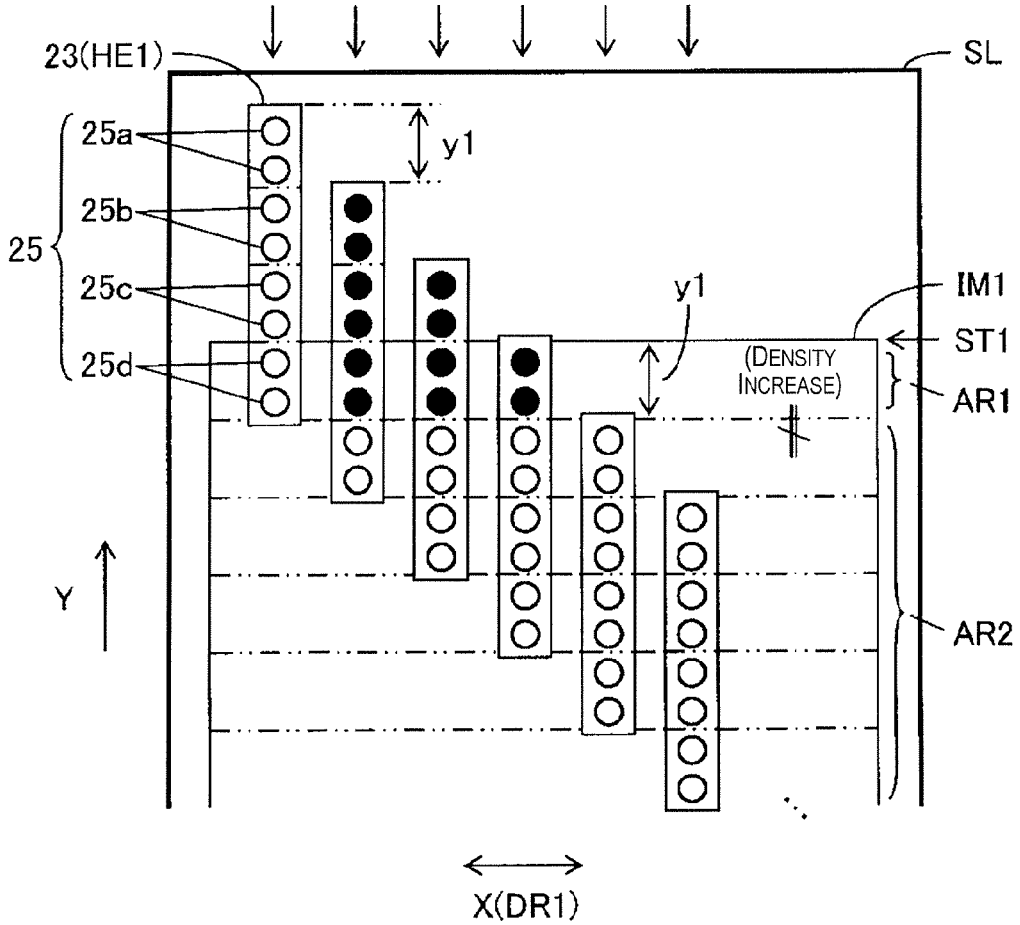
FIG. 15 is a schematic diagram summarizing the flushing method of a comparative example.

FIG. 15 schematically presents a comparative example in which an image IM1 is formed on a recording medium SL with an ink jet printer without using second mid-printing flushing means (unit). Here, the recording head 23 that constitutes the head part HE1 forms ink dots by undergoing primary scanning in the primary scan direction X and forms ink dots shifted in the feed direction Y successively by feeding of the recording medium SL in the feed direction Y (sub-scanning). With the recording head 23 in FIG. 15, the feed amount y1 is one-fourth of the band width of the dots that are formed by all of the nozzles 25 in the feed direction Y. The pass number refers to the number of primary scans, with the number of primary scans carried out at the same position on the recording medium SL in the feed direction Y taken as 1. A pass number of 0 denotes a state prior to initiation of recording of the image IM1, and recording pre-initiation flushing can be carried out. A pass number of 1 indicates the first primary scan in which dots are formed in the recording initiation region AR1 starting at a recording initiation part ST1 of the image IM1. One-fourth of the nozzles, 25*d*, on the upstream side in the feed direction Y of the plurality of nozzles 25 are used in ink ejection, and three-fourths of the nozzles, 25*a* to 25*c*, downstream in the feed direction Y are not used in ink ejection. A pass number of 2 refers to the second primary scan in which dots are formed in a region that is shifted by y1 relative to the recording medium SL where half of the nozzles, 25*c* and 25*d*, on the upstream side are used in ink ejection, and the remaining nozzles, 25*a* and 25*b*, are not used in ink ejection. A pass number of 3 means that three-quarters of the nozzles, 25*b* to 25*d*, on the upstream side are used in ink ejection and the remaining nozzles, 25*a*, are not used in ink ejection. A pass number of 4 and higher means that all of the nozzles, 25*a* to 25*d*, are used in ink ejection. Processes in which only some of the nozzles are used in ink ejection, as with passes occurring up until the end of the third pass, are referred to as upper end processes.

"Flushing" in FIG. 15 refers whether or not flushing is carried out at the end of a pass, and a circle indicates that flushing is carried out, whereas an x indicates that flushing is not carried out. In the example of FIG. 15, print pre-flushing is carried out at completion of pass 0, meaning that periodic flushing is carried out at the completion of the $7^{th}$ pass. The "cumulative time" refers to the time passed since carrying out the previous flushing, where "t" denotes the time required for one pass (e.g., seconds). It is often the case that the time required for one pass is one second or less, whereas the interval of periodic flushing is often a few seconds. It is thus often the case that flushing is not carried out at the completion of a pass.

In the first pass, nozzles 25*a* to 25*c* are not used, and it can be inferred that the ink in these nozzles 25*a* to 25*c* increases in viscosity. In FIG. 15, the nozzles presumed to have higher ink viscosity relative to the nozzles that are used for ejection are indicated by a black circle. In the second pass, the ink that presumably has higher viscosity is ejected from the nozzles 25*c* onto the recording initiation region AR1. On the third pass, the ink that presumably has higher viscosity is ejected from the nozzles 25*b* onto the recording initiation region AR1, and, on the fourth pass, the ink that presumably has higher viscosity is ejected from the nozzles 25*a* towards the recording initiation region AR1. As described above, although print pre-flushing is carried out, the nozzles that have not been used in ink ejection in upper end processing presumably have ink that has increased in viscosity relative to the nozzles that have been used in ink ejection. Actually, in comparison to region AR2, a density irregularity occurs in which the ink is thickened in the recording initiation region AR1.

As shown in FIG. 1, flushing is carried out while changing the fluid ejection conditions in a prescribed interval starting immediately after initiation of printing by the second mid-recording flushing means U22. As with the upper end process described above, when the head part HE1 is at the recording initiation part ST1 of the image IM1 that is to be formed on the recording medium SL, the second mid-recording flushing means U22 performs flushing by ejecting fluid FL1 from the nozzles 25 on the head part HE1 under second fluid ejection conditions CD2 in which at least one of the ejection frequency and quantity of ejected droplets of fluid FL1 from the nozzles 25 is greater than in the first fluid ejection conditions CD1. The head part HE1 is said to be at the recording initiation part ST1 when any of the plurality of nozzles 25 that are aligned on the head part HE1 in the feed direction Y are in a position that is adjacent to the recording initiation part ST1 of the formed image IM1. As shown in FIG. 2, the recording initiation part ST1 includes, in addition to the recording initiation part ST1*s* of the image IM1*s* that is formed first, a recording initiation part ST1*a* of the image IM1*a* that comes after a blank portion AR3 in the feed direction Y as generated between images IM1 on the recording medium SL.

In the example of FIG. 1, it is shown that when the head part HE1 having a plurality of nozzles 25 that are aligned in the feed direction Y at a predetermined nozzle pitch k is at the recording initiation part ST1, a second mid-recording flushing is carried out at the end of the pass. In this case, the increased viscosity of the ink in the nozzles 25*a* to 25*c* is eliminated at completion of one pass, and the thickness of the ink in the recording initiation region AR1 is made to match the thickness of the ink in a general region AR2. Obviously, the increase in ink viscosity in the nozzles 25*a* and 25*b* is eliminated at completion of two passes, and the increase in ink viscosity in the nozzles 25*a* is eliminated at completion of three passes, so the thickness of the ink in the recording initiation region AR1 is made to match the thickness of the ink in a general region AR2. From the above, the irregularity in density of the fluid FL1 in the recording-initiation portion of the image IM1 that is formed on the recording medium SL is reduced.

Figure 2:
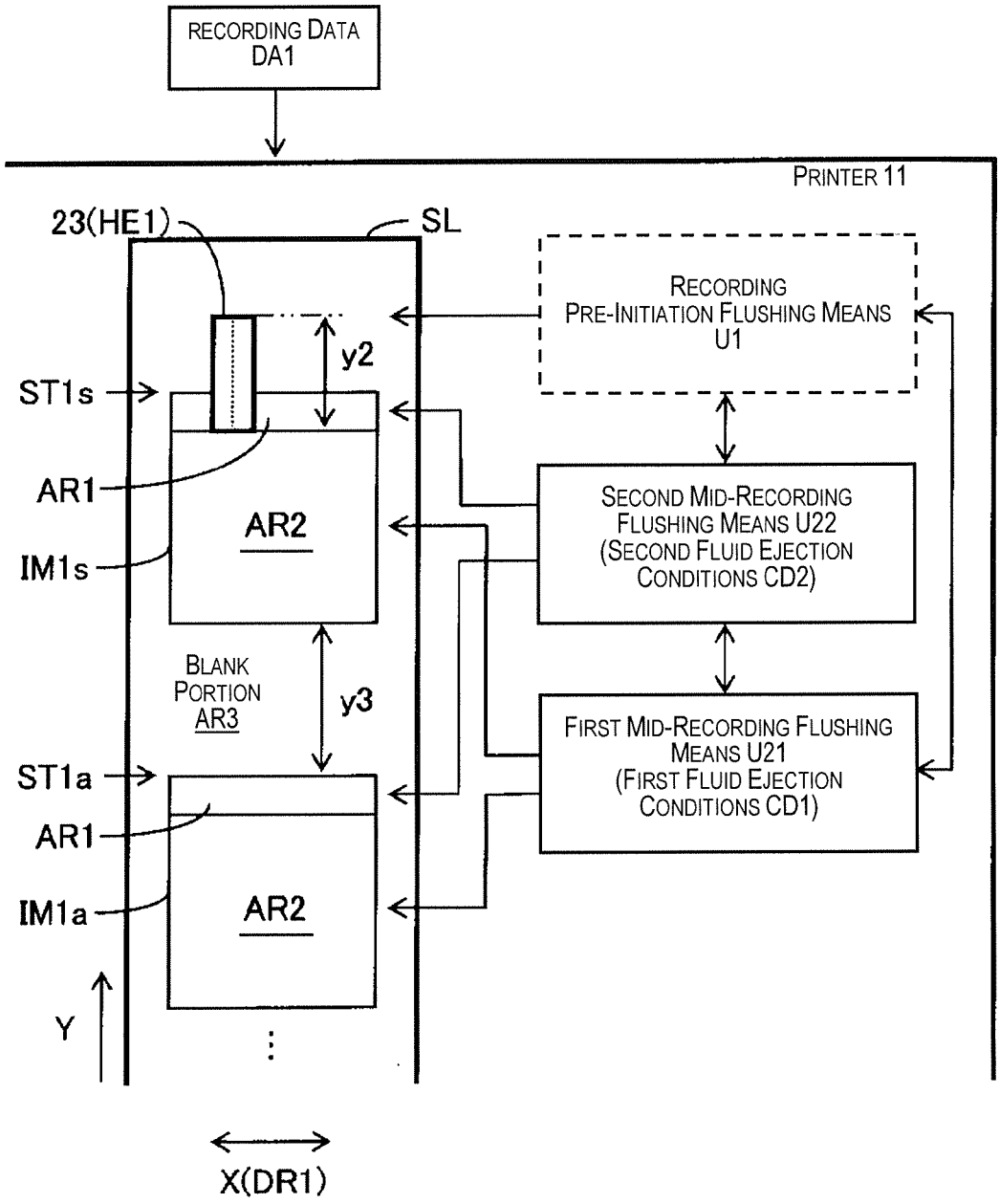
FIG. 2 is a schematic diagram showing the function of the printer (fluid ejection device) 11.

The same can be described for a recording-initiation portion on the image IM1*a* that comes after a blank portion AR3, as shown in FIG. 2. In particular, taking the feed amount in the feed direction Y of the blank portion AR3 as y3, and taking the feed amount corresponding to the band width in the feed direction Y of the dots that are formed by all of the nozzles 25 as y2, then, if y3≥y2, there will be a blank part after one pass. In this case, a time period can occur during which none of the nozzles 25 are used, and ejection of ink from each of the nozzles 25 will be the same as in the recording-initiation portion of the first image IM1*s*. Consequently, in this case as well, by carrying out a second mid-recording flushing, density irregularity of the fluid FL1 in the recording-initiation portion of the image IM1*a* will be decreased subsequent to a blank portion AR3. The effects described above are obtained by carrying out flushing through ejection of fluid FL1 from the nozzles 25 of the head part HE1 under second fluid ejection conditions CD2 in which at least one of the ejection frequency and quantity of ejected droplets of fluid FL1 from the nozzles 25 is increased relative to the first fluid ejection conditions CD1.

(2) Specific Embodiment Pertaining to a Printer

Figure 3:
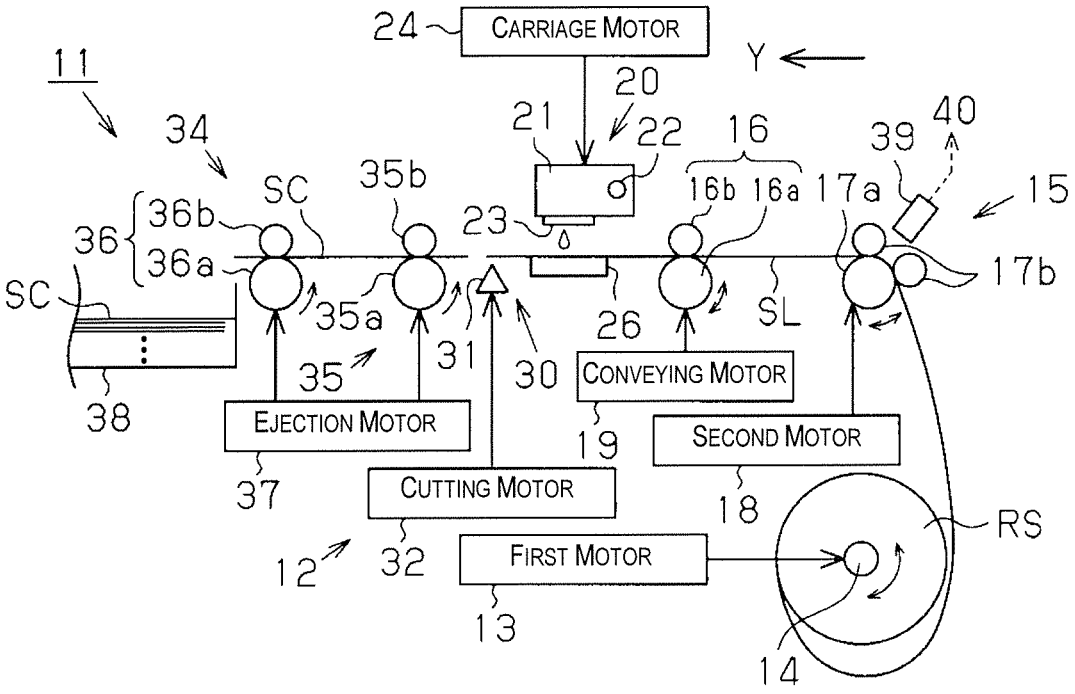
FIG. 3 is a schematic side view showing a partial sectional surface of the printer 11 of an embodiment.

An embodiment in which this technology is specified for an ink jet printer is described below with reference to FIGS. 3 to 14. The printer (fluid ejection device) 11 of this embodiment, as shown in FIG. 3, is a serial-type ink jet recording device. The printer 11 has a conveying device 12 that gradually conveys a recording medium SL from a roll RS on which printing paper recording medium SL has been wound in the form of a long sheet.

A shaft member 14 is rotatably driven in a predetermined direction by a first motor 13, and the long recording medium SL is thereby fed out along a conveyance pathway from the roll RS. The conveying device 12 has a feed-out part 15 that gradually feeds out the sheet-form recording medium SL from the roll RS and a conveying roll pair 16 that is disposed downstream from the feed-out part 15 in the direction of conveyance. With the feed-out part 15, a feed-out roll 17*a* rotates by being driven by a second motor 18, and a driven roll 17*b* is driven to rotate, thereby feeling out the recording medium SL in the downstream direction of conveyance.

The conveying roll pair 16 conveys the recording medium SL in the downstream conveyance direction as a result of rotation of a conveying roll 16*a* that is driven by a conveying motor 19 along with driven rotation of a driven roll 16*b*.

In addition, a recording unit 20 that performs recording on the recording medium SL is provided in a position that is mid-way along the feed direction Y (also referred to as "sub-scan direction") of the long recording medium SL. The feed direction Y refers to the sub-scan direction that is perpendicular to the primary scan direction X and also refers to a direction DR2 that intersects with the direction of relative movement DR1. The recording unit 20 has a carriage 21 that is provided in a condition whereby it can move reciprocatingly in the primary scan direction X as it is guided along a guide shaft 22. As an example of a plurality of recording parts, the carriage 21 has a plurality of recording heads 23 in a portion that is opposite the recording medium SL. Ink (fluid FL1) is supplied to the recording head 23 from a cartridge 82 (refer to FIG. 5) that is detachably mounted on the printer 11. The carriage 21 moves reciprocatingly in the primary scan direction X as a result of forward and reverse driving by a carriage motor 24, and ink drops are ejected towards the surface of the recording medium SL (top surface in FIG. 3) from each of the nozzles 25 through driving of drive elements PE1 in the recording head 23 during this movement. The guide shaft 22 and the carriage motor 24 constitute relative motion means (unit) U41.

Printing is then carried out on the surface of the recording medium SL by roughly alternating a line-by-line printing operation in which the recording head 23 moves once in the primary scan direction X (one pass) along with the carriage 21, and a conveying operation performed by the conveying device 12 which conveys the recording medium SL to the recording position of subsequent lines. In this embodiment, the printed image such as a photograph is printed on the recording medium SL. A support member 26 that supports the printing medium SL is provided so that it extends along the widthwise direction (primary scan direction X) of the recording medium SL in a position that is opposite the recording head 23 with the recording medium SL interposed.

In addition, in a cutting position that is downstream in the conveyance direction (left side in FIG. 3) of the recording unit 20, a cutter 31 of a cutting unit 30 moves in the transverse direction relative to the recording medium SL (primary scan direction X) as a result of driving force supplied by a cutting motor 32, and the portion of the long recording medium SL on which recording has been completed is thereby cut off. In addition, an ejection unit 34 for ejecting the cut sheet SC that has been cut from the recording medium SL farthest downstream in the conveyance direction is provided downstream from the cutting unit 30 in the conveyance direction.

The ejection unit 34 has a plurality of ejection roll pairs 35, 36 that are disposed along the feed direction Y. As a result of driving by an ejection motor 37, the rolls 35*a*, 35*b* and rolls 36*a*, 36*b* that support the recorded cut sheet SC by sandwiching it in two positions along the conveyance direction are each made to rotate, and the cut sheet SC is ejected downstream in the conveyance direction to be housed in a stacked state in an ejection tray 38. A detection sensor 39 for detecting the lead edge of the recording medium SL is provided in an upstream position in the feed direction Y relative to the conveying roll pair 16. The detection signal from this detection sensor 39 is output to a controller 40 that controls the printer 11 and is used, for example, in order to control the conveying position of the recording medium SL.

Figure 4:
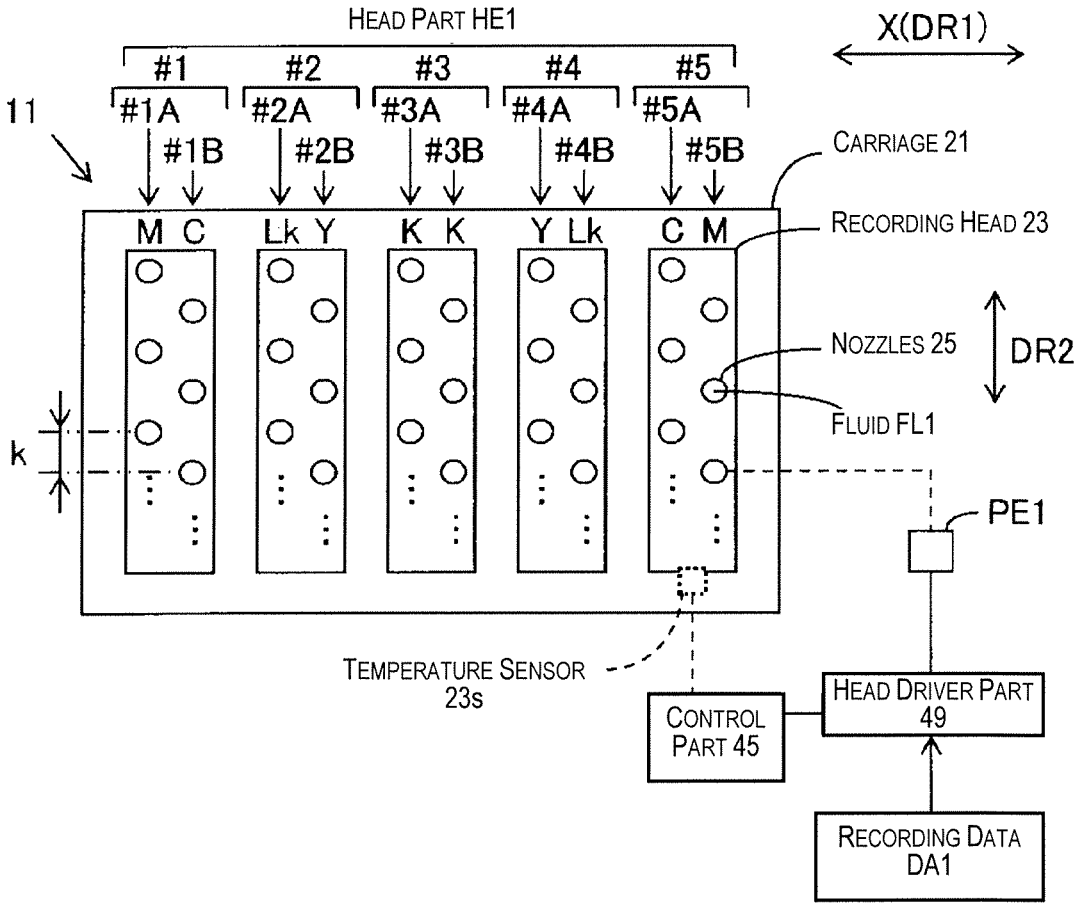
FIG. 4 is a diagram showing the bottom surface of a carriage 21 having a head part HE1.

FIG. 4 shows an example of the bottom surface of the carriage 21 that is provided with the head part HE1. The head part HE1 is partitioned into a plurality of recording heads 23 in the direction of relative movement DR1 that constitutes the primary scan direction. Each of the recording heads #H (where H is an integer of 1 to 5) has a plurality of nozzle rows that are aligned in the primary scan direction (DR1) and have a plurality of nozzles 25 (e.g., 180) that are aligned in the sub-scan direction (DR2) (that is perpendicular to the primary scan direction). Each nozzle row #HA, #HB of the recording head #H has nozzles 25 for spraying (ejecting) the fluid FL1 such as ink which are disposed at a predetermined nozzle pitch k in the sub-scan direction (DR2). Similarly, two nozzle rows #HA, #HB of the same recording head have respective nozzles 25 that are disposed in a so-called staggered form, shifted at one-half pitch (k/2) with respect to each other in the sub-scan direction (DR2).

The plurality of nozzles 25 in the example of FIG. 4 are divided into respective colors for the fluid FL1 that is ejected. Specifically, nozzles rows #1A, #5B for magenta (M) are disposed as the outermost nozzle rows that are aligned in the direction of relative movement DR1, nozzles rows #1B, #5A for cyan (C) are disposed inward thereof, nozzle rows #2A, #4B for light black (Lk) are disposed inward thereof, nozzle rows #2B, #4A for yellow (Y) are disposed inward thereof, and nozzle rows #3A, #3B for black (K) are disposed as the inwardmost rows. By disposing each of the nozzles 25 with point symmetry based on the center line of the head part HE1, the color order of the fluids FL1 will be the same during bi-directional printing ("Bi-d printing") in which printing is carried out during forward and backwards movement of the carriage 21.

Figure 6:
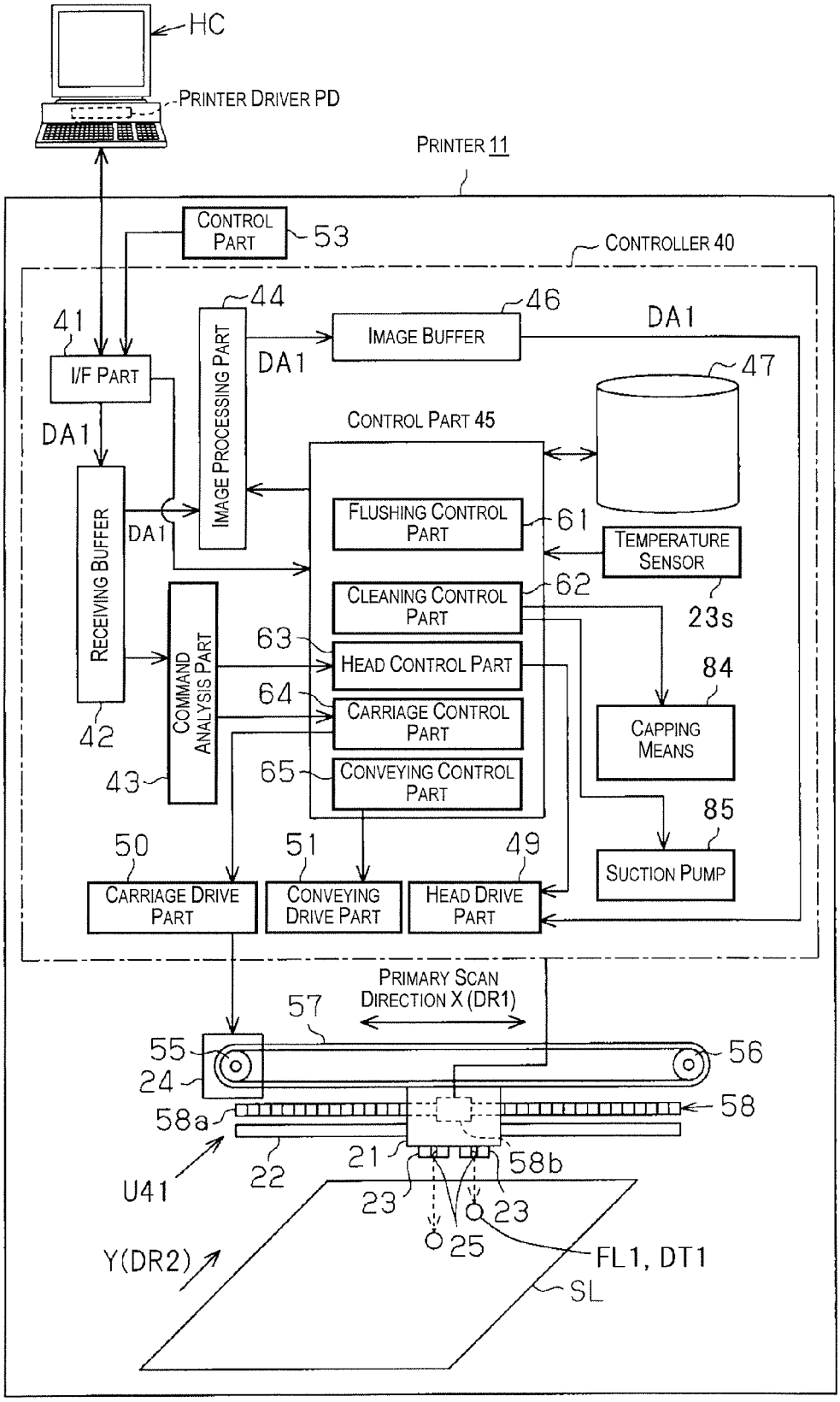
FIG. 6 is a block diagram showing the configuration of the printer 11.

The carriage 21 is moved reciprocatingly in the primary scan direction X by the relative movement means (unit) U41 shown in FIG. 6. This relative movement means U41 causes relative movement of the recording medium SL and the head part HE1 that has the plurality of nozzles 25. The printer 11 ejects fluid FL1 from the plurality of nozzles 25 in accordance with the recording data DA1. The recording data DA1 is data representing the formation state of the dots DT1 in each pixel on the recording medium SL.

The recording data DA1, as shown in FIG. 6, is input from a host device HC to an I/F part 41 and is then input to an image processing part 44 via a signal receiving buffer 42. The image processing part 44 performs predetermined image processing on the recording data DA1. After image processing, the recording data DA1 is sent to a head drive part 49 via an image buffer 46. As a result, the head drive part 49 ejects ink from the plurality of nozzles 25 in accordance with the recording data DA1 matched to a predetermined ejection timing. The image IM1 corresponding to the recording data DA1 is thereby formed on the recording medium SL.

Figure 5:
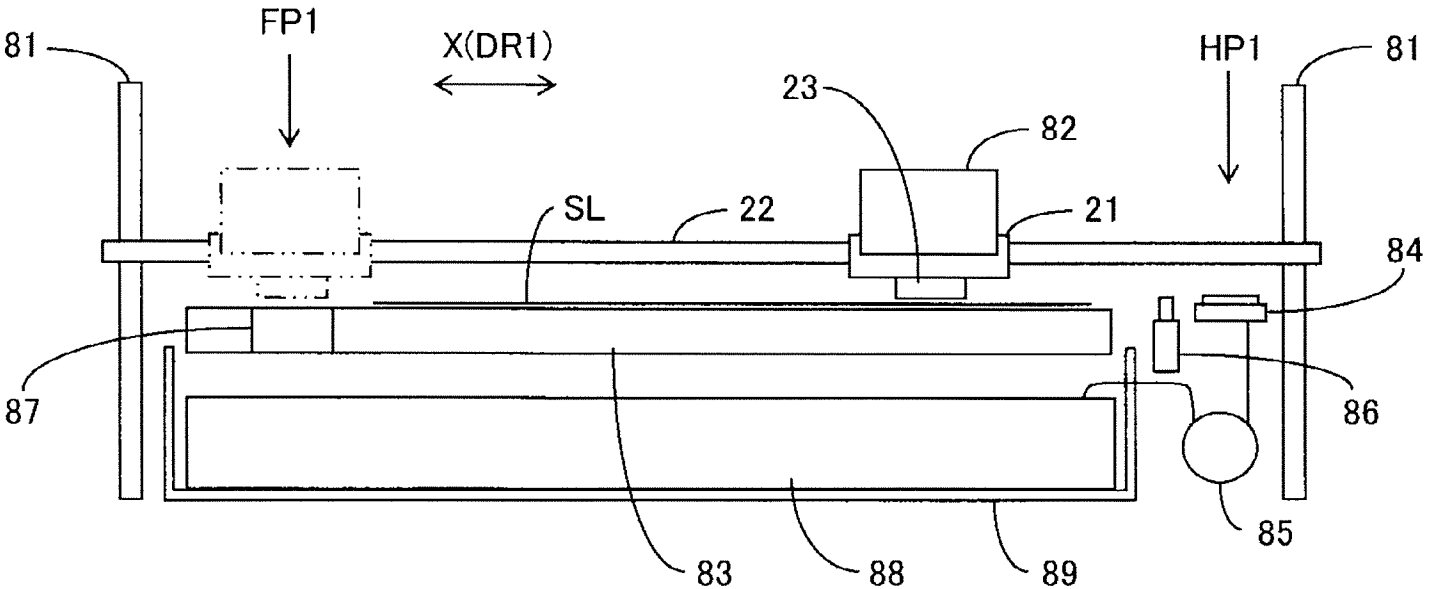
FIG. 5 is a schematic plan view of the configuration of a partial section of the printer 11.

FIG. 5 schematically shows a partial plan section of an example of the printer 11 that has a flushing function. The carriage 21 is supported horizontally by frames 81, 81 and moves reciprocatingly while being guided in the longitudinal direction on a guide shaft 22 that is oriented with its length along the primary scan direction X. An ink cartridge 82 is detachably mounted on the upper part of the carriage 21. A guide member 83 for the recording member SL is disposed below the recording head 23. The recording medium SL that is carried on the guide member 83 is moved in the feed direction Y by the conveying drive part 51 shown in FIG. 6. The capping means (unit) 84 that is disposed in a non-printing region (home position HP 1) seals the nozzle-forming surface of the printing head 23 that has moved directly above it. The suction pump 85 that is disposed below the capping means 84 creates negative pressure in the internal space of the capping means 84, thereby performing cleaning. The wiping member 86 that is disposed in the vicinity of the capping means 84 is composed of an elastic sheet made of rubber or the like and wipes the nozzle-forming surface of the recording head 23 when the carriage 21 moves towards the capping means 84.

The flushing region 87 that opens onto the guide member 83 is formed in a non-print region (flushing position FP1) and is disposed above a case 89 for housing an ink-absorbing material 88. Consequently, when the carriage 21 moves into the flushing position FP1 and ink is ejected from the nozzles of the recording head 23, ink droplets fall from the flushing region 87 through into the case 89 and are absorbed by the absorbing material 88. Flushing is thus carried out in this manner. The flushing position is not limited to a position that is opposite the home position in the primary scan direction X, and can also be a position that is on the side of the home position, or both on the side of the home position and on the opposite side therefrom.

FIG. 6 shows a schematic internal configuration of the printer 11, omitting the conveying device 12 and the drive control system thereof. The electrical configuration of the printer 11 is described below.

The printer 11 has an internal controller 40. This controller 40 receives recording data DA1 or print data from the printer driver PD of the host device HC via an I/F (interface) part 41.

The controller 40 has a central processing unit (CPU), an ASIC, a read-only memory (ROM), a non-volatile memory, and a random-access memory (RAM). The ROM stores various types of data and control programs, including flushing programs. The nonvolatile memory stores various types of data required for the printing processing and various types of programs including firmware programs. The RAM is used as a buffer for temporarily storing the results of CPU computation and the like and for holding recording data DA1 that has been received from the host device HC, as well as for holding data during and after processing of the recording data DA1.

The controller 40 has, in addition to the I/F part 41, a receiving buffer 42, a command analysis part 43, an image processing part 44, a control part 45, an image buffer 46, a nonvolatile memory 47, a head drive part 49, a carriage drive part 50, a conveying drive part 51, and the like. In addition, the printer 11 has an operational part 53 whereby the user can perform input operations. Input values are input to the control part 45 via the I/F part 41 by operation of the operational part 53. The command analysis part 43, the image processing part 44, and the control part 45 are realized in the form of at least one of a CPU (software) and ASIC (hardware) that executes control programs that are stored in the ROM. As shall be apparent, each of the parts 43 to 45 can be constructed from both software and hardware in conjunction, from software alone, or from hardware alone. The receiving buffer 42 and the image buffer 46 are constituted by RAM.

The carriage 21 is fixed as part of a timing belt 57 that is suspended across a drive pulley 55 and driven pulley 56 that are linked to a the drive shaft of the carriage motor 24. As a result of forward and reverse driving of the carriage motor 24, the carriage 21 moves reciprocatingly in the primary scan direction X via the timing belt 57 that that undergoes forward and reverse rotation. A linear encoder 58 for detecting the movement position (carriage position) of the carriage 21 is provided at a position on the back surface of the movement pathway of the carriage 21.

The linear encoder 58 has a tapered code sheet 58*a* in which a large number of slits are formed at a constant pitch (e.g., 1/180 inch=1/180×2.54 cm) and a sensor 58*b* that has a light receiving element and a light emitting element provided on the carriage 21. When the carriage 21 moves, the light that has been ejected from the light-emitting element and has passed through the code slits is received by the light receiving element, and the sensor 58*b* outputs a detection pulse. The controller 40 houses a CR position counter (not shown) that sums, for example, the pulse edges of the detection pulses that are input from the linear encoder 58 (two pulses with a phase shift of 90° between the A phase and B phase). The sum of the CR position counter is incremented when the carriage moves away from the home position, and is decremented when it moves towards the home position, so that the position of the carriage 21 can be ascertained using the home position as the zero point.

The printer driver PD generates printing data DA1 by carrying out well-known color conversion processing, resolution conversion processing, half-tone processing, and rasterization processing on the image data in a color coordinate system (e.g., the RGB color coordinate system) for display on a monitor. The recording data DA1 includes control command and print image data. The control command that is written in the header is constructed based on printing parameter data and print image data and thus is composed of various types of commands, such as conveyance system commands related to paper supply operations, paper feed operations, and paper ejection operations, and print system commands such as carriage operations and recording head operations (recording operations).

The receiving buffer 42 is a memory region (storage region) for temporarily storing recording data DA1 that has been received via the I/F part 41. The command analysis part 43 reads the header of the recording data DA1 from the receiving buffer 42 and acquires a control command therefrom, before analyzing the control command that has been written in printer description language. The results of command analysis are sent to the head control apt 63, the carriage control part 64, and the conveying control part 65 of the control part 45. The image processing part 44 reads each line (primary scan line) of the recording data DA1 from the receiving buffer 42, carries out predetermined image processing, and then stores the head image data in the image buffer 46 after image processing.

The control part 45 has a flushing control part 61, a cleaning control part 62, a head control part 63, a carriage control part 64, and a conveying control part 65.

The flushing control part 61 carries out flushing control whereby the carriage 21 is moved to the flushing position FP1 and ink is ejected from the nozzles 25. The cleaning control part 62 carries out cleaning control with respect to the nozzles 25 by moving the carriage 21 to the home position HP1 and operating the capping means 84 and the suction pump 85. The head control part 63 controls the head drive part 49 in accordance with the results of command analysis from the command analysis part 43. The carriage control part 64 discriminates the direction of movement of the carriage 21 based on the difference in the A phase and B phase of the two-phase encoder pulse signal ES that is input from the linear encoder 58. The carriage control part 64 detects the movement position of the carriage 21 from the origin position by incrementing the carriage counter during forward movement or decrementing it during reverse movement, each time the edge of the encoder pulse signal ES is detected. The position in the primary scan direction X of the carriage 21 is used for speed control of the carriage motor 24. The conveying control part 65 controls the conveying drive part 51 that drives conveyance of the recording medium SL in accordance with the results of command analysis from the command analysis part 43.

A nonvolatile semiconductor memory such as flash memory, a magnetic disk such as a hard disk, or the like can be used for the nonvolatile memory 47.

The head drive part 49 generates three types of ejection waveform pulses depending on the internal drive signal generation circuit. The ejection waveform pulse having the largest voltage differential is the voltage pulse used for ejecting ink droplets for the large dots, and the ejection waveform pulse having a moderate voltage differential is the voltage pulse that is used for ejecting ink droplets for medium dots. In terms of the four gradation values that represent large, medium, and small dots, as well as no dot, the values 0, 1, 2, and 3 can respectively correspond, for example, to "no dot", "small dot", "medium dot", and "large dot". As shall be apparent, ejection waveform pulses of one type, two types, or four or more types, also can be used for the head drive part in addition to three types. Based on the input gradation value data, the head drive part 49 selects at least one predetermined pulse in accordance with the gradation value among the three types of ejection waveform pulses and applies it to a drive element PE1 in the recording head 23.

As shown in FIG. 4, the recording head 23 houses a drive element PE1 for fluid ejection for each of the nozzles 25. Among the respective drive elements PE1, ejection waveform pulses (drive voltages) are applied to the drive element PE1 corresponding to the nozzle that is to print a pixel having a value other than the non-ejection value in the gradation value data, and an ink droplet is ejected from the nozzle corresponding to the drive element PE1. For example, if the dot value of a pixel is "1", then a voltage of the predetermined drive waveform is applied from the head drive part 49 to the drive element PE1, and ink is ejected from the nozzle 25. When the dot value of the pixel is "0", on the other hand, voltage is not applied to the drive element PE1, and ink is not ejected from the nozzle 25. The drive element PE1 can be a piezo drive element referred to as a piezo-element, an electrostatic drive element, or a heater that heats the ink and utilizes the pressure of the gas (bubble) generated by film boiling to ejection fluid from the nozzle. In addition, a temperature sensor (temperature detection means) 23*s* for detecting the temperature of the printer 11 is provided on the recording head HE1. The detection temperature of this temperature sensor 23*s* is read to the control part 45. By providing a temperature sensor 23*s* on the recording head HE1, the degree of viscosity increase of the ink is estimated, and flushing can be suitably carried out.

Next, the flushing sequence will be described in reference to the flushing tables TA1 to TA9 shown in FIG. 7 A to E and in FIG. 8 A to D. The flushing table is information that is combined in a computer program or the like whereby the control part 45 functions as the flushing control part 61. It is not necessary for the information to be recorded in the control part 45 as a collective information table.

(2-1) Second Fluid Ejection Conditions Involving Flushing Upon Completion of Each Pass With the flushing table TA1 shown in FIG. 7A, for recording pre-initiation flushing, the quantity of ejected ink droplets (e.g., corresponding to the large dots) is set to SH0 shot (where SH0 is a positive integer) for all of the nozzles 25 of the head part HE1. Recording pre-initiation flushing is carried out prior to initiation of recording and is thus carried out once for the collective recording data. In the general portion of the image IM1 that is formed during the recording process (portions excluding the recording-initiation portion), the first mid-recording flushing is carried out under first liquid ejection conditions CD1. The first liquid ejection conditions CD1 are set so that the quantity of ejected ink droplets is SH1 shot (where SH1 is a positive integer) for all of the nozzles 25 every TM1 seconds (TM1>0). There are no particular restrictions on the quantity of ejected droplets SH1, but if SH1<SH0, then ink consumption can be suitably decreased during flushing. In addition, in the recording-initiation portion of the formed image IM1, the second mid-recording flushing is carried out under the second fluid ejection conditions CD2. The second fluid ejection conditions CD2 are set so that the quantity of ejected ink droplets is SH2 shot (SH2 is a positive integer) at completion of each pass for all of the nozzles 25. There are no particular restrictions on the quantity of ejected droplets SH2, but if SH2<SH0, then it is possible to suitably decrease ink consumption due to flushing. In the examples of flushing tables TA2 to TA9 described below, the recording pre-initiation flushing and the first recording pre-initiation flushing are set to the same conditions as in the flushing table TA1.

Figure 9:
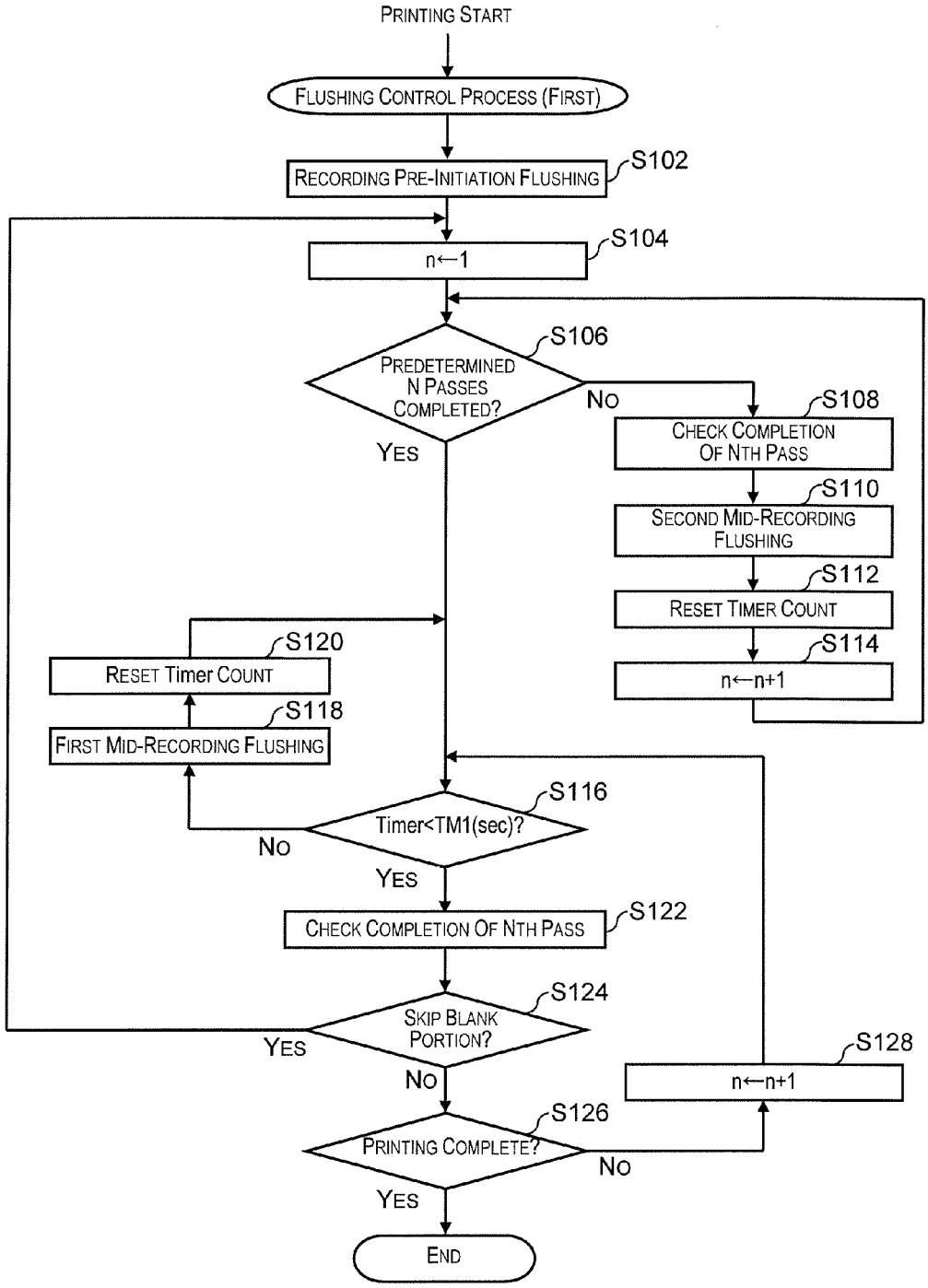
FIG. 9 is a flow chart showing a flushing control process (first) in which the second fluid ejection conditions CD2 involve flushing at a pass completion interval.
Figure 10:
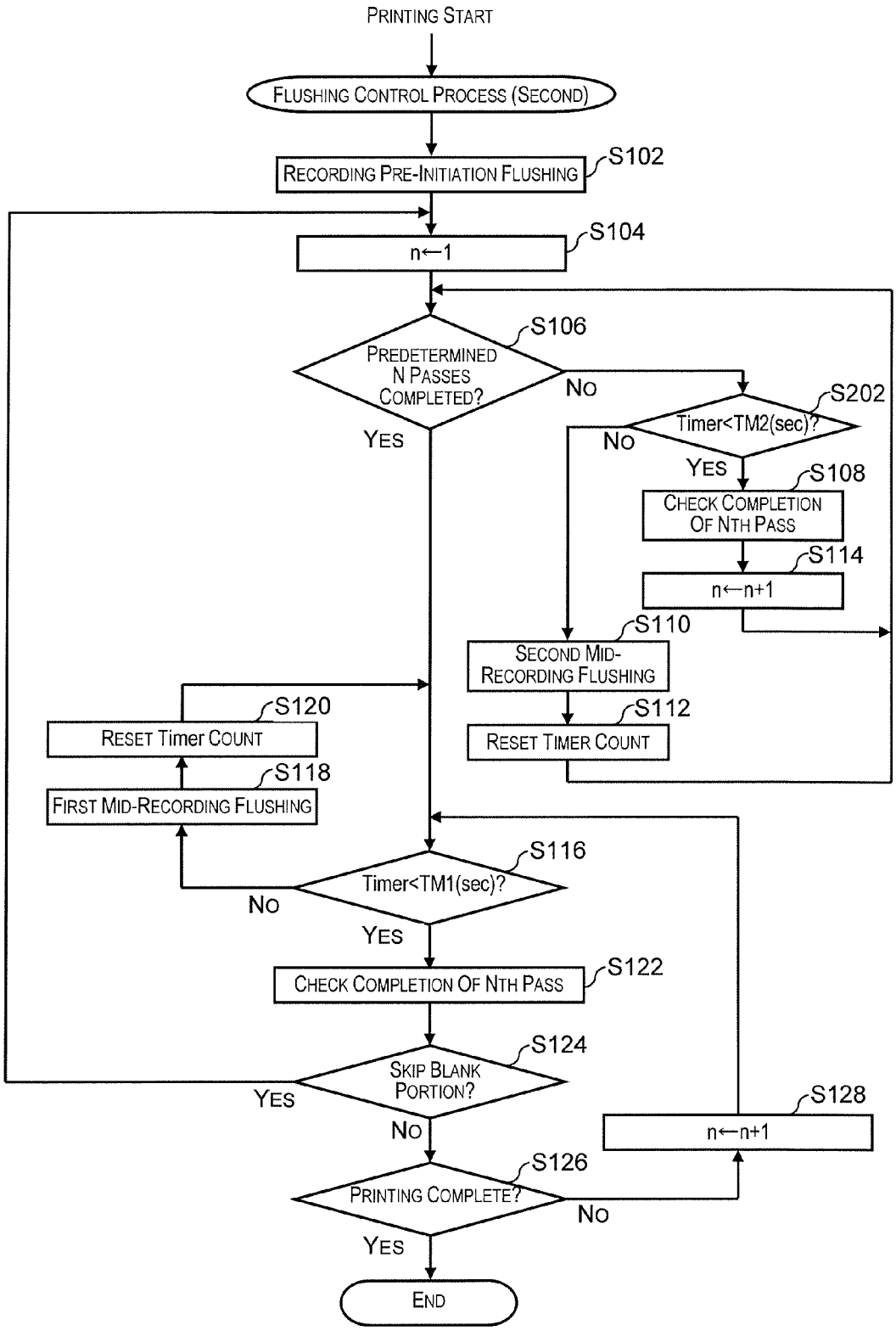
FIG. 10 is a flow chart showing a flushing control process (second) in which the second fluid ejection conditions CD2 involve flushing at a short interval.
Figure 12:
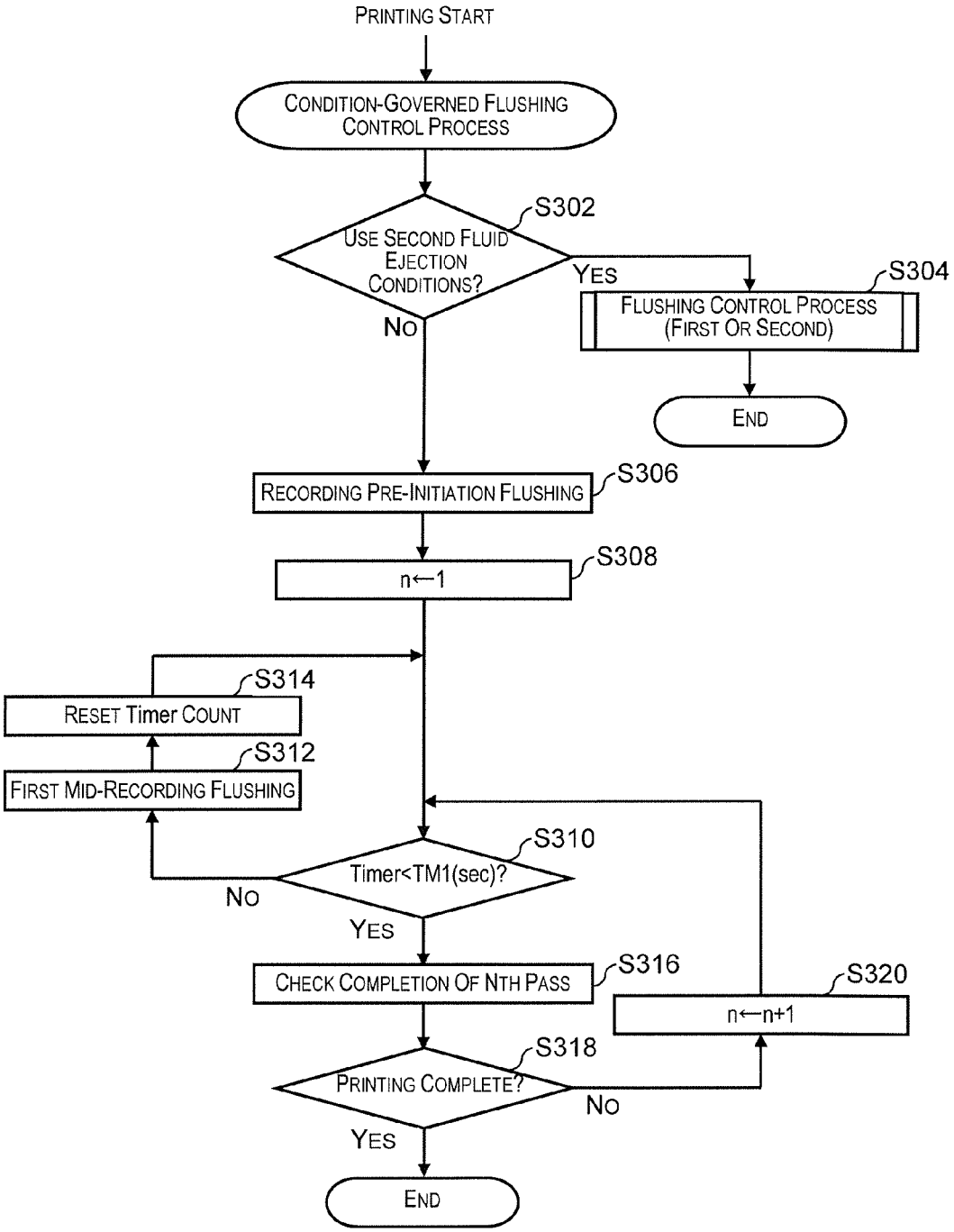
FIG. 12 is a flow chart showing a condition-governed flushing control process in which it is determined whether flushing is performed based on the second fluid ejection conditions CD2.

FIG. 9 presents a flow chart showing an example of the flushing control process (first) in which the second fluid ejection conditions CD2 involve flushing upon completion of each pass in accordance with the flushing table TA1. This process is carried out with the flushing control part 61 as the main unit, and initiates with initiation of the printing process (recording process) in accordance with collective recording data DA1, by multitasking in parallel with other processes. The processes shown in FIGS. 10 and 12 are similar. Step S102 corresponds to the recording pre-initiation flushing means U1, steps S116 to S128 correspond to the first mid-recording flushing means U21, and steps S104 to S114 correspond to the second mid-recording flushing means U22. The term "step" is omitted below. When the flushing control process (first) is initiated, the flushing control part 61 ejects ink from all of the nozzles 25 at droplet ejection quantity SH0, thereby performing recording pre-initiation flushing (S102). In S104, a counter n in the RAM of the controller 40 is set to 1. The value of the counter n indicates the number of passes from the recording initiation part ST1 of the formed image IM1.

In S106, the counter n is compared with a predetermined pass number N in order to switch from the second fluid ejection conditions CD2 to the first fluid ejection conditions CD1 in which the ink ejection frequency is decreased, and a determination is made as to whether the predetermined number of passes N have been completed. In the example of FIG. 1, the second mid-recording flushing can be carried out at the completion of each pass up until completion of the third pass, and so N is set to 4, and a determination is made as to whether n<N. If the predetermined number of passes N have not been completed, then the processes of S108 to S114 are carried out, whereas if the predetermined N passes have been completed, then processing is carried out starting from S116.

In S108, completion of the nth pass is confirmed. In S110, the second mid-recording flushing is carried out by ejecting ink from all of the nozzles 25 under second fluid ejection conditions CD2 in which SH2 shot ink droplets are ejected from all of the nozzles 25. To describe this in reference to FIG. 5, the carriage 21 moves to the flushing position FP1 upon completion of the $n^{th}$ pass, and SH2 shot ink droplets are ejected from all of the nozzles 25. In this manner, the second mid-recording flushing is carried out upon completion of each pass in the flushing initiation portion prior to reaching N passes. In the example of FIG. 1, when image formation is carried out with each pass being about 0.4 seconds, the second mid-recording flushing is carried out approximately every 0.4 sec up until completion of 3 passes in the recording-initiation portion. In S112, the count of the timer that is provided in the RAM of the controller 40 is reset to 0 sec. This timer is used for establishing the execution timing of the second mid-recording flushing that is carried out periodically. Subsequently, the flushing control part 61 adds 1 to the counter n (S114), and the process returns to S106.

On the other hand, when the predetermined number of passes N have been completed, the flushing control part 61 determines whether the timer has reached the execution time TM1 for the first mid-recording flushing (S116). If the timer has reached the execution time TM1 (condition not satisfied), then the first mid-recording flushing is carried out in which ink is ejected from all of the nozzles 25 under the first fluid ejection conditions CD1 in which SH1 shot ink droplets are ejected from all of the nozzles 25 (S118). In reference to FIG. 5, when TM1 seconds have passed from the previous mid-recording flushing, the carriage 21 is moved to the flushing position FP1, and SH1 shot ink droplets are ejected from all of the nozzles 25. Subsequently, the flushing control part 61 resets the count of the timer to 0 (S120) and returns the process to S116. In this manner, the first mid-recording flushing is carried out at each execution time TM1 subsequent to completion of N passes. For example, in the example shown in FIG. 1, the first mid-recording flushing is carried out every 7 seconds subsequent to completion of 4 passes when TM1=7.

In S116, when the timer reaches execution time TM1, the running flushing control part 61 checks for completion of the nth pass (S122). In S124, a determination is made as to whether the blank portion AR3 has been skipped, as shown in FIG. 2. This determination process can involve, for example, a process in which a determination is made based on the recording data DA1 as to whether or not a blank portion AR3 has been generated for R1 or more rasters (R1 is a positive integer) in the feed direction Y between formed images IM1. R1 can be set in accordance with the desired image quality, and can be a feed amount y2 corresponding to the band width in the feed direction of the dots that are formed by all of the nozzles 25. When the condition is satisfied, the flushing control part 61 returns the process to S104. As a result, the counter n represents the number of passes from the recording initiation part ST1*a* of the formed image IM1*a* coming after the blank portion AR3 in the feed direction Y.

When the condition is not satisfied in S124, the flushing control part 61 determines whether or not the printing process has been completed in accordance with the collective recording data DA1 (S126). When the condition is not satisfied, the flushing control part 61 adds 1 to the counter n (S128) and returns the process to S116. On the other hand, when the condition is satisfied, the flushing control part 61 completes the flushing control process (first).

As described above, when the head part HE1 is at the recording initiation part ST1 of the formed image IM1 as with the upper end process, the second mid-recording flushing is carried out in which the ejection frequency of fluid FL1 from the nozzles 25 is increased. Consequently, in this embodiment, density irregularity of the fluid FL1 in the recording-initiation portion of the image IM1 that is formed on the recording medium SL can be reduced.

(2-2) When the Second Fluid Ejection Conditions Involve Flushing with a Short Timer Interval With the flushing table TA2 shown in FIG. 7B, the second fluid ejection conditions CD2 for flushing carried out in the recording-initiation portion of the formed image IM1 are set for mid-recording flushing at an execution time TM2 which is longer than execution time TM1 for the first fluid ejection conditions CD1 (0<TM2<TM1).

FIG. 10 shows a flow chart of the flushing control process (second) in which the second fluid ejection conditions CD2 in accordance with the flushing table TA2 involve mid-recording flushing at a short execution time TM2. This process adds the process of S202 relative to the flushing control process (first) of FIG. 9, and thus the order of S108 to S114 is changed. Other than this, the process is the same as the flushing control process (first), and descriptions are thus omitted.

When it is determined that the predetermined number of passes N have not been completed in S106, the flushing control part 61 determines whether or not the timer has reached the short execution time TM2 for the second mid-recording flushing (S202). When the condition is satisfied, the second mid-recording flushing is carried out in which ink is ejected from all of the nozzles 25 under second fluid ejection conditions CD1 involving ejection of SH2 shot ink droplets from all of the nozzles 25 (S110). As described in reference to FIG. 5, When TM2 seconds has passed from the previous flushing, the carriage 21 is moved to the flushing position FP1, and SH2 shot ink droplets are ejected from all of the nozzles 25. Subsequently, the flushing control part 61 resets the timer count to 0 sec (S112) and returns the produces to S106. In this manner, the second mid-recording flushing is carried out at each short execution time TM2 prior to completion of N passes of the recording-initiation portion.

In S202, when the timer has not reached the execution time TM2, the flushing control part 61 checks for completion of the nth pass (S108). Subsequently, the flushing control part 61 adds 1 to the counter n (S114) and returns the process to S106. From the above, when the head part HE1 is in the recording initiation part ST1 of the formed image IM1, the second mid-recording flushing is carried out in which the ejection frequency of fluid FL1 from the nozzles 25 is increased. Accordingly, in this embodiment as well, density irregularity of the fluid FL1 in the recording-initiation portion of the formed image can be reduced.

(2-3) When the Second Fluid Ejection Conditions Involve Flushing at a High Ink Droplet Ejection Quantity In the flushing table TA3 shown in FIG. 7C, the second fluid ejection conditions CD2 for flushing carried out in the recording-initiation portion of the formed image involve setting the mid-recording flushing at an ink droplet ejection quantity SH3 which is greater than the ink quantity of ejected droplets SH1 for the first fluid ejection conditions CD1 (where SH3 is an integer that is larger than SH1). The flushing control process according to the flushing table TA3 is carried out in accordance with the flow charts shown in FIGS. 9 and 10. In these flow charts, when the second mid-recording flushing is carried out in S110, the flushing control part 61 supplies drive voltage from the head drive part 49 to the respective drive elements PE1 whereby ink droplets are ejected from all of the nozzles 25 at exactly the droplet ejection quantity SH3 that is larger than the quantity of ejected droplets SH1 of the first fluid ejection conditions CD1. Specifically, ejection operations from the respective nozzles 25 are made to occur in the respective drive elements PE1 SH3 times, and ink droplets are thus ejected SH3 times. As a result, when the head part HE1 is in the recording initiation part ST1 of the formed image, the second mid-recording flushing is carried out with a high quantity of ejected droplets of the fluid FL1 from the nozzles 25. Consequently, in this embodiment as well, density irregularity in the fluid FL1 in the recording-initiation portion of the formed image can be reduced.

(2-4) When Nozzles that are not Used in Image Formation are Placed in Second Fluid Ejection Conditions In the flushing table TA4 shown in FIG. 7D, the second fluid ejection conditions CD2 for flushing that is carried out in the recording-initiation portion of the formed image are set for those nozzles of the plurality of nozzles 25 that are not being used in formation of the image IM1. The flushing control process according to the flushing table TA4 are can be carried out in accordance with the flow charts shown in FIGS. 9 and 10.

Figure 11A:
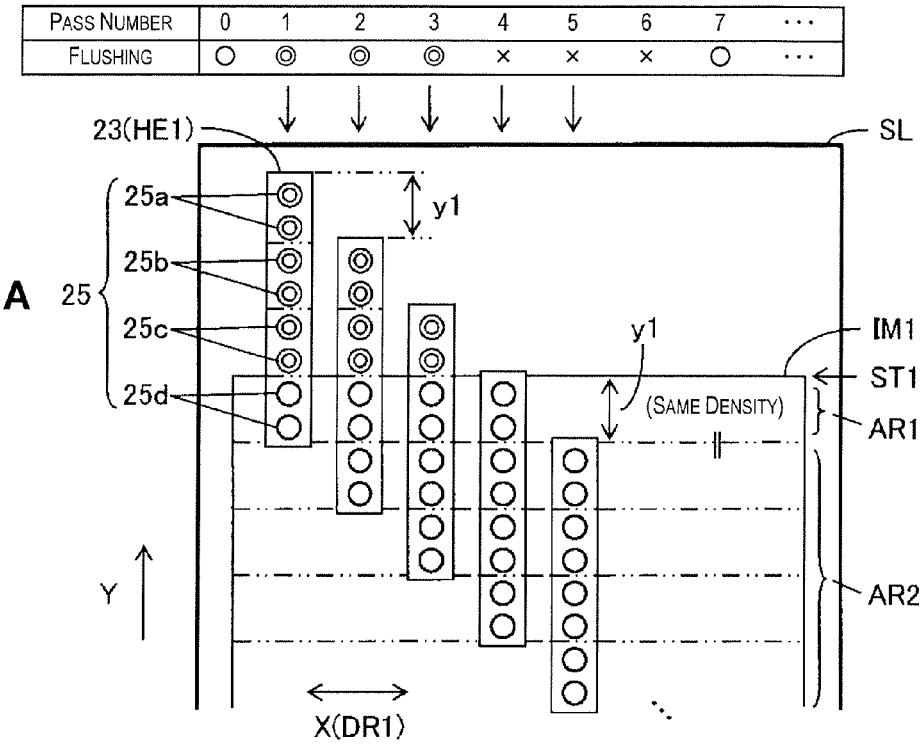
FIG. 11 is A a schematic diagram of a situation in which nozzles that are not being used in the formation of the image IM1 are placed under second fluid ejection conditions CD2; and B a schematic diagram of a situation in which the nozzles that are under the second fluid ejection conditions CD2 are restricted to nozzles that have moved into the position of the formed image IM1 from a position in front of the recording initiation part ST1 in the feed direction Y during feeding of the recording medium.

FIG. 11A schematically shows a situation in which nozzles that are not used in forming the image IM1 are placed under second fluid ejection conditions CD2 for the flushing control process (first) of FIG. 9 in which mid-recording flushing is carried out at completion of each pass in the recording-initiation portion. Those nozzles with double circles in FIGS. 11A and B are the nozzles for which flushing is carried out at completion of a pass. As shown in FIG. 11A, at completion of one pass, one-fourth of the nozzles 25*d* on the upstream side in the feed direction Y, among the plurality of nozzles 25, have been used in ink ejection, and three-fourths of the nozzles 25*a* to 25*c* on the downstream side in the feed direction Y have not been used in ink ejection. Thus, at completion of one pass, flushing is carried out by ejecting ink only from nozzles 25*a* to 25*c* on the downstream side that have not been used in image formation. At completion of two passes, half of the nozzles 25*c*, 25*d* on the upstream side have been used in ink ejection, and the remaining nozzles 25*a*, 25*b* have not been used in ink ejection. At completion of two passes, flushing is carried out by ejecting ink only with the unused nozzles 25*a*, 25*b* on the downstream side. At completion of three passes, three-fourths of the nozzles 25*b* to 25*d* on the upstream side have been used in ink ejection, and the remaining nozzles 25*a* have not been used in ink ejection. At completion of three passes, flushing is thus carried out by ejecting ink only with the unused nozzles 25*a* on the downstream side.

From the above, with nozzles 25 that have not been used in forming the image IM1, the second mid-recording flushing is carried out whereby at least one of the ejection frequency and quantity of ejected droplets of fluid FL1 is increased. Consequently, in this embodiment, density irregularity of the fluid FL1 in the recording-initiation portion of the formed image can be reduced, and the consumed amount of fluid FL1 in the second mid-recording flushing can be reduced.

(2-5) When Second Fluid Ejection Conditions are Used that are Restricted to Nozzles that have Moved from a Position in Front of the Recording Initiation Part in the Feed Direction to a Position of Image Formation During Feeding of the Recording Medium In the flushing table TA5 shown in FIG. 7E, the second fluid ejection conditions CD2 for flushing carried out in the recording-initiation portion of the formed image are set for those nozzles, among the plurality of nozzles 25, that have moved from a position that is in front of the recording initiation part ST1 in the feed direction Y to a position that is at the formed image IM1 during feeding of the recording medium SL. The flushing control process according to the flushing table TA5 can be carried out in accordance with the flow charts shown in FIGS. 9 and 10.

Figure 11B:
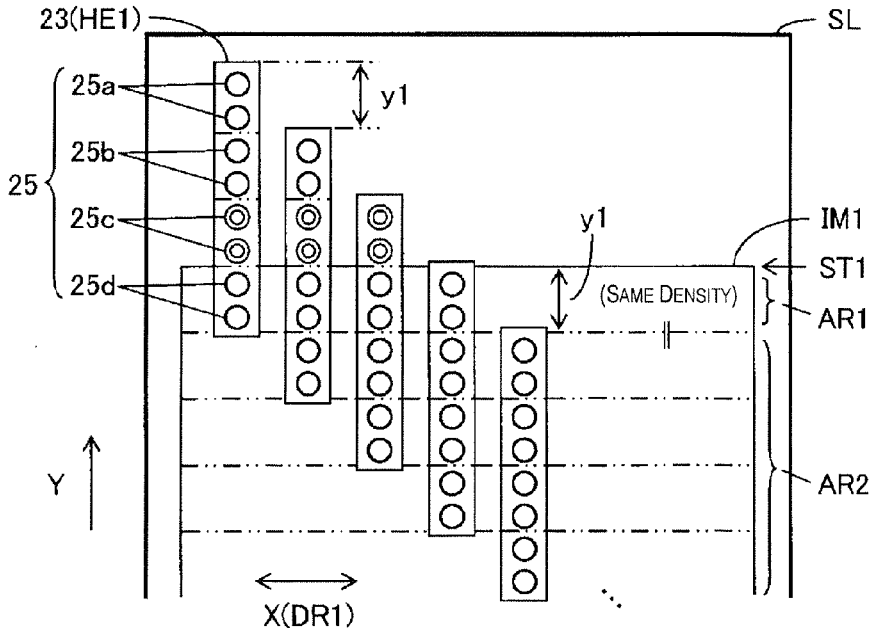

FIG. 11B schematically shows a situation in which nozzles that have moved from a position that is in front of the recording initiation part ST1 in the feed direction Y to a position that is at the formed image IM1 during feeding of the recording medium SL are placed under second fluid ejection conditions CD2 for the flushing control process (first) of FIG. 9 in which mid-recording flushing is carried out at completion of each pass in the recording-initiation portion. As shown in FIG. 11B, at completion of one pass, one-fourth of the nozzles 25*d* on the upstream side in the feed direction Y among the plurality of nozzles 25 have been used for ink ejection, whereas three-fourths of the nozzles 25*a* to 25*c* on the downstream side in the feed direction have not been used for ink ejection. In this embodiment, at completion of one pass, flushing is carried out by ejecting ink only from the nozzles 25*c* that are used in the subsequent second pass. The nozzles 25*c* are those nozzles that have moved from a position that is in front of the recording initiation part ST1 in the feed direction to a position that is at the formed image IM1 during feeding of the recording medium at completion of one pass. At completion of two passes ½ of the nozzles 25*c*, 25*d* on the upstream side have been used in ink ejection, whereas the remaining nozzles 25*a*, 25*b* have not been used in ink ejection. In this embodiment, at completion of two passes, flushing is carried out by ejecting ink with the nozzles 25*b* that are used in the subsequent third pass. The nozzles 25*b* have not been flushed at completion of one pass. For this reason, by flushing the nozzles 25*b* at an ink droplet ejection quantity that is greater than the ink droplet ejection quantity during flushing of the nozzles 25*c* at completion of one pass, increase in ink viscosity can be more suitably eliminated, and ink density irregularity in the recording-initiation portion can be more suitably decreased. At completion of three passes, three-fourths of the nozzles 25*b* to 25*d* on the upstream side have been used in ink ejection, and the remaining nozzles 25*a* have not been used in ink ejection. With this embodiment, at completion of three passes, flushing is carried out by ejecting ink only with the nozzles 25*a* that are used in the subsequent fourth pass. The nozzles 25*a* are not flushed at completion of one and two passes. For this reason, by flushing the nozzles 25*a* out at an ink droplet ejection quantity that is greater than the ink droplet ejection quantity during flushing of the nozzles 25*b* at completion of two passes, increase in ink viscosity can be more suitably eliminated, and ink density irregularity in the recording-initiation portion can be more suitably decreased.

From the above, with the nozzles 25 that are not used in forming the image IM1, the second mid-recording flushing is carried out whereby at least one of the ejection frequency and quantity of ejected droplets of fluid FL1 is increased. On the other hand, nozzles 25 that are still in a position that is in front of the recording initiation part ST1 during feeding of the recording medium SL are not used in ejection of the fluid FL1. Consequently, in this embodiment, density irregularity of the fluid FL1 in the recording-initiation portion of the formed image can be reduced, and the consumed amount of fluid FL1 in the second mid-recording flushing can be reduced.

(2-6) When Execution of the Second Mid-Recording Flushing is Selected in Accordance with the Temperature of the Fluid Ejection Device With the flushing Table TA6 shown in FIG. 8A, a setting is used in which the determination of whether to carry out the second mid-recording flushing is made depending on the temperature of the printer 11, based on a predetermined temperature TE1° C. Settings are used in which the fluid ejection conditions for flushing carried out in the recording-initiation portion of the formed image are switched from the first fluid ejection conditions CD1 to the second fluid ejection conditions CD2 when the detection temperature of the temperature sensor 23*s* is TE1° C. or greater, whereas no switch from the first fluid ejection conditions CD1 occurs if the detection temperature of the temperature sensor 23*s* is less than TE1° C.

FIG. 12 shows a flow chart of the condition-governed flushing control process whereby the second mid-recording flushing is carried out depending on the detection temperature in accordance with the flushing table TA6. When the condition-governed flushing control process is initiated, the flushing control part 61 determines whether or not to use the second fluid ejection conditions CD2 in accordance with the temperature that is detected by the temperature sensor 23*s* (S302). Specifically, the process of S302 involves selecting whether or not to carry out flushing by the second mid-recording flushing means U22 in accordance with the temperature of the printer 11. When the detected temperature is equal to or greater than TE1° C., the condition is satisfied, and the flushing control part 61 carries out the flushing control process as shown in FIGS. 9 and 10 (S304), so that the flushing control process is completed in accordance with conditions. Specifically, after carrying out recording pre-initiation flushing, if the head part HE1 is at the recording initiation part ST1 of the formed image, then flushing is carried out under second fluid ejection conditions CD2 for at least some of the nozzles 25, and flushing is carried out under first fluid ejection conditions CD1 for the rest.

On the other hand, when the detected temperature is less than TE1° C., then the condition is not satisfied, and the flushing control part 61 ejects ink from a plurality of nozzles 25 at the first fluid ejection conditions CD1, and condition-governed flushing control processing is completed by carrying out the first mid-recording flushing. For example, the flushing control part 61 carries out recording pre-initiation flushing (S306), sets the counter n to 1 (S308), and determines whether the timer has reached execution time TM1 for the first mid-recording flushing (S310). If the timer has reached the execution time TM1, then the first mid-recording flushing is carried out under the first fluid ejection conditions CD1 (S312), the count of the timer is reset to 0 sec (S314), and the process is returned to S310. If the timer has not reached the execution time TM1, completion of the nth pass is checked (S316), it is determined whether the printing process has completed (S318), and if this condition is not satisfied, then 1 is added to the counter n (S320), and the process returns to S310.

For example, when TE1=35° C., and the detection temperature is 35° C. or greater, flushing is carried out at the second fluid ejection conditions CD2 for at least some of the nozzles 25 when the head part HE1 is at the recording initiation part ST1 of the formed image. On the other hand, flushing is not carried out under the second fluid ejection conditions CD2 when the detection temperature is less than 35° C. When the temperature of the printer 11 is low, the increase in viscosity of the ink is slowed, and so mid-recording flushing in the recording-initiation portion of the formed image IM1 can be omitted, depending on circumstances. From the above, density irregularity in the fluid FL1 in the recording-initiation portion of the formed image can be reduced, flushing can be carried out in accordance with the temperature of the fluid ejection device (11), and the consumed amount of fluid FL1 in the second mid-recording flushing can be suitably decreased.

Whether or not to carry out the second mid-recording flushing can also be selected in accordance with environment such as humidity, as well as temperature. For example, a humidity sensor can be provided on the recording head 23, the detection signal from the humidity sensor can be read by the control part 45, and the second mid-recording flushing can be carried out if the detected humidity is at or below a predetermined level, HU1° C., whereas the second mid-recording flushing is not carried out if the detected humidity is greater than HU1° C. When the humidity is high, increase in ink viscosity is slowed, and so the second mid-recording flushing can be omitted, depending on circumstances.

(2-7) When the Second Fluid Ejection Conditions are Fluid Ejection Conditions Determined in Accordance with Detection Temperature With flushing table TA7 shown in FIG. 8B the second fluid ejection conditions CD2 are set at fluid ejection conditions in accordance with the temperature of the printer 11. The fluid ejection conditions for flushing carried out in the recording-initiation portion of the formed image are set for mid-recording flushing at each execution time TM2 that is shorter than the execution time TM1 for the first fluid ejection conditions CD1 (0<TM2<TM1) if the detection temperature of the temperature sensor 23*s* is TE1° C. or greater. On the other hand, if the detection temperature of the temperature sensor 23*s* is less than TE1° C., mid-recording flushing is set to occur at each execution time TM3 where TM1>TM3>TM2. In this example, the ink droplet ejection quantity SH4 below TE1° C. is 0<SH4<SH2 in the recording-initiation portion. When the temperature of the printer 11 is low, the increase in ink viscosity is slowed, and so the ink droplet ejection quantity can be reduced and the mid-recording flushing interval can be increased in the recording-initiation portion of the formed image IM1, depending on circumstances. As shall be apparent, the mid-recording flushing interval alone can be increased, or the ink droplet ejection quantity alone can be decreased.

The flushing control process according to the flushing table TA7 can be carried out in accordance with the flow chart shown in FIG. 10. In the determination process of S202 in FIG. 10, when the detection temperature of the temperature sensor 23*s* is less than TE1 then it can be determined whether or not the timer has reached the execution time TM3 for the second mid-recording flushing. As a result, density irregularity in the fluid FL in the recording-initiation portion of the formed image can be reduced, flushing can be carried out in accordance with the temperature of the fluid detection device (11), and the consumed amount of fluid FL1 in the second mid-recording flushing can be suitably decreased.

The second fluid ejection conditions can also be fluid ejection conditions that depend on the environment, such as humidity. For example, the detection signal from a humidity sensor that is provided on the recording head 23 can be read by the control part 45, and, if the detected humidity is higher than a predetermined level HU1° C., the second mid-recording flushing can be carried out at an interval that is longer than the interval of the second mid-recording flushing when the humidity is at or below HU1° C., in a range of being shorter than the first mid-recording flushing. When the humidity is high, the increase in ink viscosity slows, and so the interval of the second mid-recording flushing can be increased, depending on circumstances.

(2-8) When Execution of the Second Mid-Recording Flushing is Determined in Accordance with the Image Formation Mode The fluid ejection device can also form the image IM1 on the recording medium SL in various image formation modes, depending on the type of recording medium feeding, the resolution, the recording rate, the recording pass number, the recorded image type, the recording medium type, and the like.

Figure 13A:
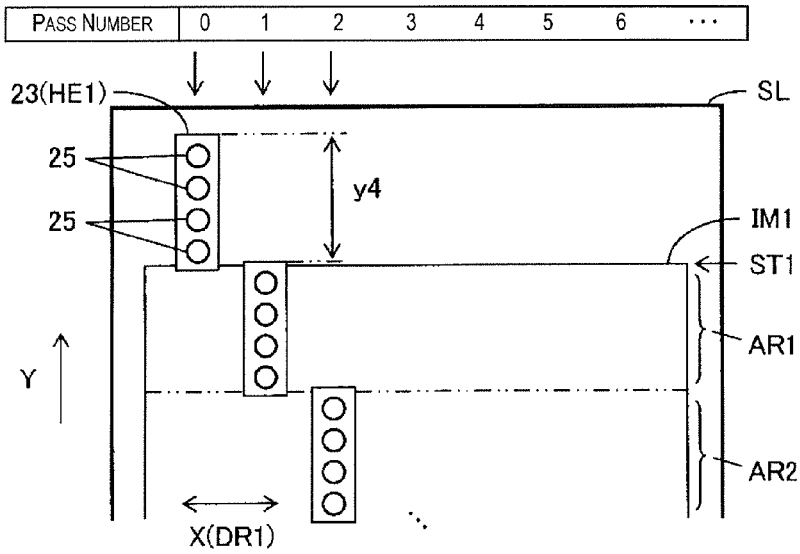
FIG. 13 is A a diagram showing band feeding; and B a diagram showing interlace feeding.

FIG. 13A schematically shows feeding of the recording medium SL that is carried out when the image formation mode for forming the image is a band feed mode. With the recording head 23 in this case, the band width in the feed direction Y of the dots that are formed by all of the nozzles 25 is taken to be the feed amount y4. Specifically, with the band feed mode, settings are used in which the recording medium SL is fed in the feed direction Y by units of the plurality of nozzles 25 that are aligned in the feed direction Y. In the first pass, all of the nozzles 25 are used for forming the recording initiation region AR1 of the image IM1. This means that imbalance arises in the increase in ink viscosity in the plurality of nozzles 25 in the recording-initiation portion of the formed image IM1. Feeding in FIG. 13A is not overlap print feeding, because one raster is formed in one pass.

Figure 13B:
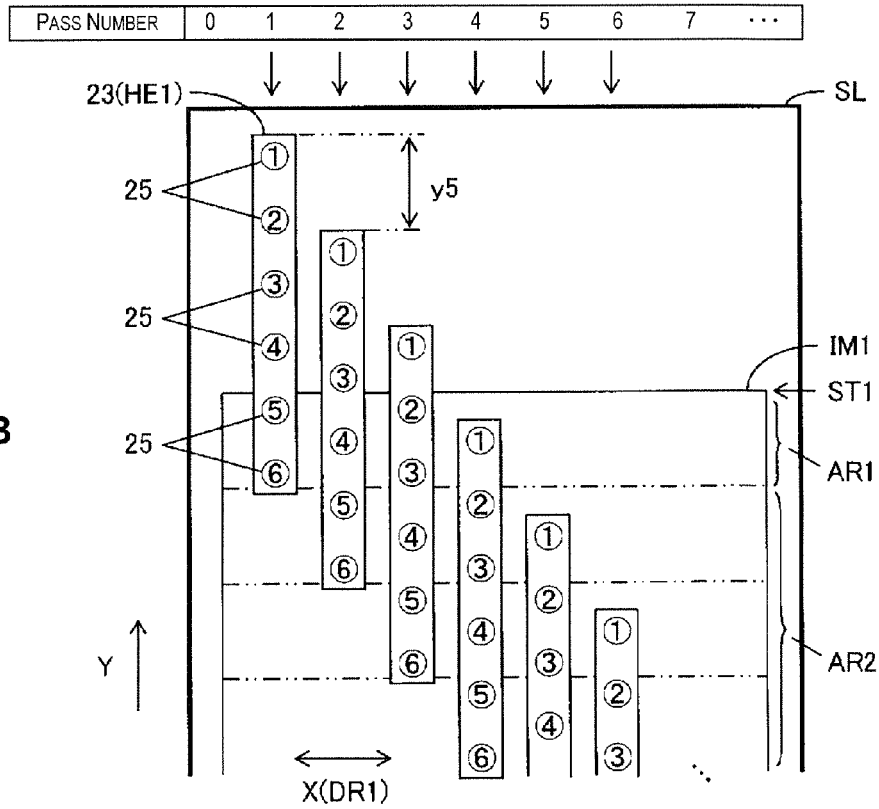

FIG. 13B schematically shows feeding of the recording medium SL carried out when the image formation mode is an interlace mode. With the recording head 23, in this case, the feed amount y5 is one-fourth of the band width in the feed direction Y of the dots that are formed by all of the nozzles 25. Specifically, interlace mode provides settings whereby the recording medium SL is fed in the feed direction Y in units that are smaller than the units of the plurality of nozzles 25 that are aligned in the feed direction Y. With the first pass, ⅓ of the nozzles (circle 5, circle 6) on the upstream side in the feed direction Y of the plurality of nozzles 25 are used in ink ejection, and ⅔ of the nozzles (circle 1 to circle 4) on the downstream side in the feed direction Y are not used in ink ejection. On the second pass, half of the nozzles (circle 4 to circle 6) on the upstream side are used in ink ejection, and the remaining nozzles (circle 1 to circle 3) are not used in ink ejection. On the third pass, five-sixths of the nozzles (circle 2 to circle 6) on the upstream side are used in ink ejection, and the remaining nozzles (circle 1) are not used in ink ejection. On the fourth and subsequent passes, all of the nozzles are used in ink ejection. Consequently, in the recording-initiation portion of the formed image IM1, imbalance in the degree of increase in ink viscosity tends to arise in the plurality of nozzles 25. Feeding in FIG. 13B is overlap print feeding because one raster is formed in two passes.

In addition, the resolution dot formation mode can be set to resolution modes such as high resolution mode (e.g., 2880×1440 dpi), mid-resolution mode (e.g., 1440×720 dpi), and low-resolution mode (e.g., 720×360 dpi). There is a trade-off in dot formation mode between recording speed and resolution, and the high-resolution mode, mid-resolution mode, and low-resolution mode can be understood respectively as being the high-quality mode, normal mode, and high-speed mode. With a dot formation mode for the number of recording passes, the pass number mode can be set, such as a one-pass mode in which the dots of one raster are formed in one pass, or a two-pass mode in which the dots of one raster are formed in two passes. The recording rate is dependent on the recording pass number, and the one-pass mode can be equated with the high-speed mode, and the two-pass mode can be equated with the normal mode.

The quality of the recorded image is dependent on the resolution, the recording rate, the recording pass number, and the like. Thus, the resolution, recording rate, recording pass number, and the like can be set depending on the type of recording medium, and the dot formation mode can be provided in accordance with the type of recorded image. For example, when the recorded images are primarily photographs, in order to inhibit color deviation, a setting can be considered in which the dots of one raster are formed in two passes. When the recorded images are primarily text, settings can be considered in which the dots of one raster are formed in one pass in order to increase the rate of dot formation. In addition, the quality of the image that is formed on the recording medium is dependent on the type of recording medium. The resolution, recording rate, recording pass number, and the like, can be set depending on the type of recording medium, and the dot formation mode can be set in accordance with the type of recorded image. For example, when glossy paper or other coated paper such as photographic paper is used, in order to inhibit color deviation, settings can be considered in which the dots of one raster are formed in two passes. When uncoated paper such as common paper or recycled paper is used, settings can be considered in which the dots of one raster are formed in one pass in order to increase the rate of dot formation.

Figure 14A:
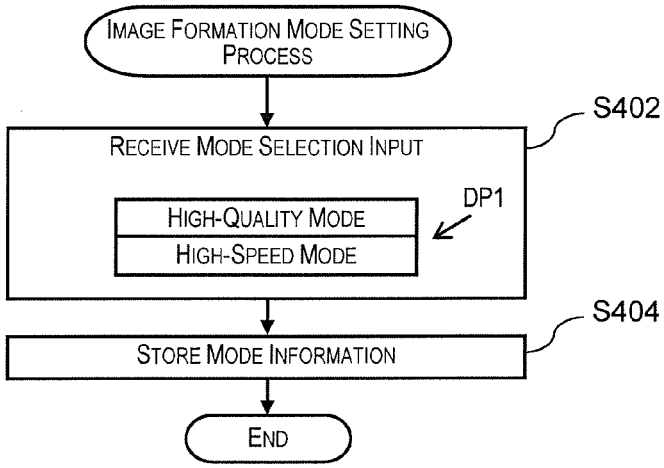
FIG. 14 shows flow charts (A and B) showing the process of a modification example.

FIG. 14A is a flow chart showing the processes of fluid ejection device (printer 11) used for setting the image formation mode. In this process, the control part 45 of the printer is the main unit, and, for example, by operating an operational part 53, a mode selection item is selected from a menu that is displayed on a screen that is not shown in the drawings. This is carried out by multitasking in parallel with other processes. The dot formation mode setting process can also be carried out on a host device HC.

When the image formation mode setting process is initiated, the control part 45 displays the mode selection screen DP1 on the operational part 53, and an operational input is received for selecting the image formation mode from among a plurality of image formation modes (S402). As shown in FIG. 14A, the mode selection screen DP1 displays image formation mode items such as high-quality mode, high-speed mode, and the like. The high-quality mode is set for image formation in an overlap printing interlace mode, and the high-speed mode is set for image formation in the band feed mode. The control part 45 then stores mode information representing the received image formation mode in the nonvolatile memory 47 or the like (S404), completing the image formation mode setting process.

With the flushing table TA8 shown in FIG. 8C, whether or not the second mid-recording flushing is carried out changes depending on a plurality of image formation modes. With the fluid ejection conditions for flushing carried out in the recording-initiation portion of the formed image, settings are used in which the conditions are switched to the second fluid ejection conditions CD2 from the first fluid ejection conditions CD1 when the image formation mode is the interlace mode, whereas the conditions are not changed from the first fluid ejection conditions CD1 when the image formation mode is a band feed mode.

With condition-governed flushing control processing in which whether or not to carry out the second mid-recording flushing is determined in accordance with the image formation mode in accordance with the flushing table TA8, processing can be carried out in accordance with the flow chart shown in FIG. 12. When condition-governed flushing control processing is initiated, the flushing control part 61 determines whether to use the second fluid ejection conditions CD2 in accordance with the image formation mode that is set (S302).

Figure 14B:
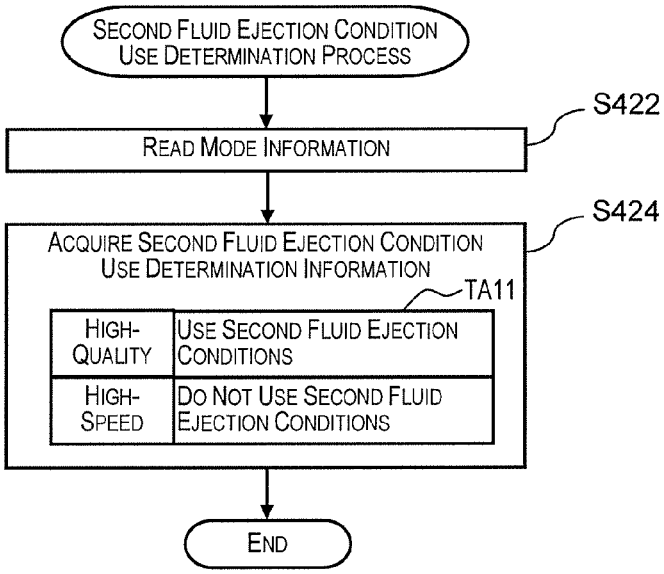

FIG. 14B shows the process for determining whether or not to use the second fluid ejection conditions CD2 in 5302 described above. As a precondition for this process, the use/non-use table TA11 is stored in nonvolatile memory 47 or the like, where this table is an information table that associates image formation modes and whether or not to use the second fluid ejection conditions CD2. When the process is initiated, the flushing control part 61 reads mode information from the nonvolatile memory 47 (S422). The flushing control part 61 references the use/non-use table TA11, acquires information corresponding to the read mode information, specifically, information concerning whether or not to use the second fluid ejection conditions CD2 (S424), and then completes the second fluid ejection conditions use determination process. For example, when the mode information indicates the high-quality mode, information to use the second fluid ejection conditions CD2 is acquired, and the condition is satisfied in S302 of FIG. 12. On the other hand, if the mode information indicates the high-speed mode, then information not to use the second fluid ejection conditions CD2 is acquired, and the condition is not satisfied in S302 of FIG. 12.

The flushing control part 61 carries out the process of S304 when the condition is satisfied in S302 of FIG. 12 and ends the condition-governed flushing control process. S306 to S320 are carried out when the condition is not satisfied in S302 of FIG. 12, and the condition-governed flushing control process is then ended. Specifically, with the process of S302, whether or not to carry out flushing by the second mid-recording flushing means U22 is selected in accordance with the image formation mode. For example, when the image formation mode is an interlace mode, the condition is satisfied, and the flushing control part 61 carries out the flushing control process shown in FIGS. 9 and 10 (S304), and then ends the condition-governed flushing control process. Specifically, after carrying out recording pre-initiation flushing, flushing is carried out using the second fluid ejection conditions CD2 with at least some of the nozzles 25 when the head part HE1 is at the recording initiation part ST1 of the formed image, whereas flushing is carried out under the first fluid ejection conditions CD1 with the rest.

On the other hand, when the image formation mode is the band feed mode, then the condition is not satisfied, and the flushing control part 61 ejects ink from the plurality of nozzles 25 under the first fluid ejection conditions CD1 to perform the first mid-recording flushing, whereupon the condition-governing flushing control process is ended. As described above, with the band feed mode, imbalance in the increase in ink viscosity does not tend to occur in the plurality of nozzles 25 in the recording-initiation portion of the formed image IM1, and thus mid-recording flushing in the recording-initiation portion of the formed image IM1 can be omitted, depending on circumstances. Consequently, density irregularity of the fluid FL1 can be reduced in the recording-initiation portion of the formed image, flushing can be carried out in accordance with the image formation mode, and the consumed amount of fluid FL 1 in the second mid-recording flushing can be suitably decreased.

(2-9) When the Second Fluid Ejection Conditions are Fluid Ejection Conditions Determined in Accordance with the Image Formation Mode In the flushing table TA9 shown in FIG. 8D, the second fluid ejection conditions CD2 are set as the fluid ejection conditions in accordance with the image formation mode. The fluid ejection conditions for flushing carried out in the recording-initiation portion of the formed image are set for mid-recording flushing to occur at a short execution time TM2 that is shorter than the execution time TM1 for the first fluid ejection conditions CD1 when the image formation mode is the interlace mode ($0<TM2<TM1$). On the other hand, when the image formation mode is the band feed mode, mid-recording flushing is set to occur at each execution time TM3, where $TM1>TM3>TM2$. In this case, in the recording-initiation portion, the band feed mode ink droplet ejection quantity SH4 is such that $0<SH4<SH2$. With the band feed mode, imbalance in the increase in ink viscosity does not tend to occur in the plurality of nozzles 25 in the recording-initiation portion of the formed image IM1, and so the interval of mid-recording flushing can be lengthened, or the ink droplet ejection quantity can be reduced in the recording-initiation portion of the formed image IM1, depending on circumstances. As shall be apparent, the mid-recording flushing interval alone can be increased, or the ink droplet ejection quantity alone can be reduced.

The flushing control process in accordance with the flushing table TA9 can be carried out in accordance with the flow chart shown in FIG. 10. With the determination process of S202 in FIG. 10, when the image formation mode is the band feed mode, a determination can be made as to whether the time has reached the execution time TM3 for the second mid-recording flushing. As a result, density irregularity of the fluid FL in the recording-initiation portion of the formed image can be reduced, flushing can be carried out in accordance with the image formation mode, and the consumed amount of the fluid FL1 in the second mid-recording flushing can be suitably decreased.

(3) Modification Example

With the embodiments described above, the following modifications can be made. The sequence of the various steps of the processes described above can be suitably altered. For example, in FIGS. 9 and 10, the blank portion skip determination process of S124 can be carried out if the condition is not satisfied in the printing termination determination process of S126. With the printing devices in which Bi-d printing is carried out, the second mid-recording flushing in the recording-initiation portion of the formed image can be carried out every two passes during forwards and backwards movement. This second mid-recording flushing is suitable when the flushing position is only in one of the primary scan directions. With printing devices that involve band feeding as well, by carrying out the second mid-recording flushing when only some of the nozzles are used in ink ejection in the first pass, density irregularity of the ink in the recording-initiation portion of the formed image can be reduced.

In addition to paper, the recording medium can be a resin sheet, metal film, cloth, film substrate, resin substrate, semiconductor wafer, or a storage medium such as an optical disk or magnetic disk. The shape of the recording medium, in addition to a long sheet, can be cut sheets such as single-sheet paper, square paper, and the like.

In addition to a color ink jet printer, the printing device can be a monotone or dot impact-type printer, a laser printer, a scanner, or a multifunctional machine equipped with reading means (unit) such as a scanner or colorimeter. The fluid ejection device in which the invention can be employed can be a printer, or a fluid ejection device that is equipped with a fluid ejection head or the like that sprays (ejects) micro-volume droplets or other devices that ejection fluids other than ink. The term "droplets" used herein refers to the state of the fluid upon ejection from the fluid ejection device, and includes droplets that leave a trail in the shape of particles, tears, or threads. The fluid referred to herein is any material that can be ejected by the fluid ejection device, for example, substances in a condition whereby the material is in liquid-phase, high- or low-viscosity liquid-form materials, sols, aqueous gels, inorganic solvents, organic solvents, solutions, liquid-form resins, liquid-form metals (melted metal) and other fluids. In addition, the state of the material state is not restricted; materials can also be used that are produced by using a solvent to dissolve, disperse, or mix particles of functional material composed of solids such as pigments or metal particles. Inks and liquid crystals are typical examples of fluids. The ink can be a typical water-based ink or oil-based ink and can also include various types of fluid compositions such as gel inks and hot met inks. The fluid ejection means (unit) includes devices that ejection a fluid that contains a material such as an electrode material or a color material in a dispersed or dissolved state, which are used, for example, in the production of liquid crystal displays, EL (electroluminescence) displays, surface emission displays, and color filter structures. In addition, fluid ejection devices also include devices that eject biological organic substances that are used in the production of biochips, devices that are used as micropipettes for the ejection of sample fluids, textile printing devices, microdispensers, devices that perform pinpoint ejection of lubricating oil in precision devices such as watches or cameras, devices that eject transparent resin liquids onto substrates such as ultraviolet-curing resins for forming tiny hemispherical lenses (optical lenses) for optical information elements, and devices that eject etching liquid such as acid or alkali in order to etch substrates or the like. Although the fluid is preferably a non-gas fluid, it can be a particulate material such as a toner. This is because nozzle clogging also will presumably occur with particulate materials over long non-ejection intervals.

It is not necessary for mid-recording flushing to be carried out depending on the image formation mode or temperature, and it is not necessary to limit the nozzles that are involved in the second mid-recording flushing. As shall be apparent, the actions and effects described above can be substantially obtained by a device, method, program, or the like that does not have constituent elements pertaining to the subordinate claims and only has constituent element related to the independent claims.

As described above, in accordance with various modes of the invention, a technology or the like can be offered whereby density irregularities of the fluid in the recording-initiation portion of an image that is formed on a recording medium are minimized. In addition, the invention can be worked by switching, or changing combinations of, the various constituent elements disclosed in the embodiments and modification examples described above, and the invention can also be worked by switching, or changing combinations of, the respective constituent elements that are disclosed in the embodiments and modification examples described above along with those that have been disclosed in the past. Consequently, the invention is not limited to the embodiments and modification examples described above and also includes configurations and the like that result from switching, or changing combinations of, the various constituent elements that are disclosed in the embodiments and modification examples described above along with those that have been disclosed in the past.

What is claimed is:

1. A fluid ejection device comprising:

a head part having a plurality of nozzles, the plurality of the nozzles ejecting a fluid toward a recording medium in accordance with recording data while the recording medium is fed in a feed direction with respect to the head part, the plurality of the nozzles being aligned on the head part in the feed direction of the recording medium, the plurality of the nozzles further ejecting the fluid so that flushing of the plurality of the nozzles is carried out; and a controller configured to carry out the flushing of the plurality of the nozzles, the controller controlling the plurality of the nozzles to eject the fluid and carrying out the flushing under a first fluid ejection condition during a recording process in accordance with the recording data, all of the plurality of the nozzles of the head part being located upstream in the feed direction of the recording medium relative to a first recording initiating part of a first image that is formed on the recording medium under the first fluid ejection condition, the first recording initiating part of the first image being a downstream end of the first image in the feed direction of the recording medium, the controller controlling the plurality of the nozzles to eject the fluid and carrying out the flushing under a second fluid ejection condition in which ejection frequency of the fluid ejected from the plurality of the nozzles is greater than ejection frequency of the fluid ejected from the plurality of the nozzles under the first fluid ejection condition, or quantity of droplets of the fluid ejected from the plurality of the nozzles is greater than quantity of the droplets of the fluid ejected from the plurality of the nozzles under the first fluid ejection condition, at least one of the plurality of the nozzles of the head part being located downstream in the feed direction of the recording medium relative to the first recording initiation part of the first image during the recording process under the second fluid ejection condition.

2. The fluid ejection device according to claim 1, wherein the controller further ejects the fluid from the plurality of the nozzles and carries out the flushing under the second fluid ejection condition while the head part is in a second recording initiation part of a second image that comes after, relative to the feed direction, a blank portion generated between the first and the second images on the recording medium.

3. The fluid ejection device according to claim 1, wherein the controller carries out the flushing under the second fluid ejection condition with nozzles, among the plurality of the nozzles, that have not been used in image formation.

4. The fluid ejection device according to claim 3, wherein the controller carries out flushing only with nozzles, of the plurality of the nozzles, that have moved from a position that is in front of the first recording initiation part to a position that is on the formed first image in the feed direction during feeding of the recording medium.

5. The fluid ejection device according to claim 1, further comprising a temperature detection unit for detecting the temperature of the fluid ejection device, and whether or not the flushing is to be carried out is selected in accordance with the temperature that is detected by the temperature detection unit.

6. The fluid ejection device according to claim 1, wherein the fluid ejection device forms the first image on the recording medium in a plurality of image formation modes related to image formation, and whether or not the flushing is to be carried out is selected in accordance with the image formation modes.

7. The fluid ejection device according to claim 1, wherein the controller switches the controlling of the plurality of the nozzles from under the second fluid ejection condition to under the first fluid ejection condition at a timing of a nozzle that is disposed at a most downstream end in the feed direction of the recording medium moving from a downstream side to an upstream side relative to the first initiating part of the first image in the feeding direction of the recording medium.

8. A flushing method comprising:

ejecting fluid from a plurality of nozzles that a head part has and carrying out flushing under a first fluid ejection condition during a recording process in accordance with recording data, the plurality of the nozzles ejecting the fluid toward a recording medium in accordance with the recording data while the recording medium is fed in a feed direction with respect to the head part, the plurality of the nozzles being aligned on the head part in the feed direction of the recording medium, all of the plurality of the nozzles of the head part being located upstream in the feed direction of the recording medium relative to a recording initiating part of an image that is formed on the recording medium under the first fluid ejection condition, the recording initiating part of the image being a downstream end of the image in the feed direction of the recording medium; and ejecting the fluid from the plurality of the nozzles and carrying out the flushing under a second fluid ejection condition in which ejection frequency of the fluid ejected from the plurality of the nozzles is greater than ejection frequency of the fluid ejected from the plurality of the nozzles under the first fluid ejection condition, or quantity of droplets of the fluid ejected from the plurality of the nozzles is greater than quantity of the droplets of the fluid ejected from the plurality of the nozzles under the first fluid ejection condition, at least one of the plurality of the nozzles of the head part being located downstream in the feed direction of the recording medium relative to the recording initiation part of the image during the recording process under the second fluid ejection condition.

9. The flushing method according to claim 8, further comprising switching the ejecting of the fluid from the nozzles and the carrying out of the flushing from under the second fluid ejection condition to under the first fluid ejection condition at a timing of a nozzle that is disposed at a most downstream end in the feed direction of the recording medium moving from a downstream side to an upstream side relative to the initiating part of the image in the feeding direction of the recording medium.

10. A non-transitory computer readable storage medium recording a computer-readable program that prompts a device to execute functions of:

ejecting fluid from a plurality of nozzles that a head part has and executing flushing under a first fluid ejection condition during a recording process in accordance with the recording data, the plurality of the nozzles ejecting the fluid toward a recording medium in accordance with recording data while the recording medium is fed in a feed direction with respect to the head part, the plurality of the nozzles being aligned on the head part in the feed direction of the recording medium, all of the plurality of the nozzles of the head part being located upstream in the feed direction of the recording medium relative to a recording initiating part of an image that is formed on the recording medium under the first fluid ejection condition, the recording initiating part of the image being a downstream end of the image in the feed direction of the recording medium; and ejecting the fluid from the plurality of the nozzles and executing flushing under a second fluid ejection condition in which ejection frequency of the fluid ejected from the plurality of the nozzles is greater than ejection frequency of the fluid ejected from the plurality of the nozzles under the first fluid ejection condition, or quantity of droplets of the fluid ejected from the plurality of the nozzles is greater than quantity of the droplets of the fluid ejected from the plurality of the nozzles under the first fluid ejection condition, at least one of the plurality of the nozzles of the head part being located downstream in the feed direction of the recording medium relative to the recording initiation part of the image during the recording process under the second fluid ejection condition.

11. The non-transitory computer readable storage medium according to claim 10, further comprising switching the ejecting of the fluid from the nozzles and the executing of the flushing from under the second fluid ejection condition to under the first fluid ejection condition at a timing of a nozzle that is disposed at a most downstream end in the feed direction of the recording medium moving from a downstream side to an upstream side relative to the initiating part of the image in the feeding direction of the recording medium.

* * * * *